US005572242A

United States Patent [19]

Fujii et al.

[11] Patent Number: 5,572,242

[45] Date of Patent: Nov. 5, 1996

[54] INKJET HAVING RECOVERY SYSTEM CONTROL METHOD AND APPARATUS OPERATING DURING PERIODS OF NON-USE

[75] Inventors: Masahiro Fujii; Susumu Hama; Hiroshi Takizawa; Masahiro Minowa, all of Suwa, Japan

[73] Assignee: Seiko Epson Corporation, Tokyo, Japan

[21] Appl. No.: 25,310

[22] Filed: Mar. 2, 1993

[30] Foreign Application Priority Data

Mar. 2, 1992 [JP] Japan ..... 4-044495
Nov. 10, 1992 [JP] Japan ..... 4-300094

[51] Int. Cl.[6] ..... B41J 2/165

[52] U.S. Cl. ..... 347/23; 347/2; 347/35

[58] Field of Search ..... 347/2, 3, 22, 23, 347/26, 29, 30, 33, 35, 60, 5

[56] References Cited

U.S. PATENT DOCUMENTS

| | | | |
|---|---|---|---|
| 4,204,776 | 5/1980 | Lee | 400/119 |
| 4,450,454 | 5/1984 | Koto | 347/29 X |
| 4,534,623 | 8/1985 | Araki | 350/339 R |
| 4,558,332 | 12/1985 | Takahashi | 34/22 X |
| 4,785,312 | 11/1988 | Toyomura | 346/76 PH |
| 4,903,232 | 2/1990 | O'Connell | 364/900 |
| 4,967,204 | 10/1990 | Terasawa et al. | 347/23 |
| 4,970,527 | 11/1990 | Gatten | 347/35 |
| 5,175,566 | 12/1992 | Ejiri et al. | 347/23 |

FOREIGN PATENT DOCUMENTS

| | | | |
|---|---|---|---|
| 388986 | 9/1990 | European Pat. Off. . | |
| 0451846 | 10/1991 | European Pat. Off. . | |
| 56-24875 | 3/1981 | Japan . | |
| 61-56109 | 12/1986 | Japan . | |
| 3-234541 | 10/1991 | Japan | 347/23 |
| 3-293153 | 12/1991 | Japan | 347/23 |
| 4-90359 | 3/1992 | Japan | 347/23 |

OTHER PUBLICATIONS

Eurodisplay '90 Proceedings, "Large-Size TFD (MIM)-LCD For High Grade Lap-Top Computer Terminals" by H. Morita et al., pp. 366-369.

*Primary Examiner*—John E. Barlow, Jr.
*Attorney, Agent, or Firm*—Eric B. Janofsky

[57] ABSTRACT

A highly reliable ink-jet printer or printing mechanism capable of consistent ink discharge in an on-demand type ink-jet printer. The printing mechanism is equipped with an ink-jet head having a plurality of ink nozzles that discharge ink drops and pressure generating elements corresponding to the nozzles, for applying pressure to the ink therein. A timer measures a preselected time period and a recovery processor controls recovery operations for each nozzle. The recovery operations are executed at prescribed time intervals during non-operation of the ink-jet head based on timer output. The recovery processor performs recovery processing when the power source is powered on. Further, an automatic power disconnection is performed when the number of consecutive recovery performed in response to the output of the timer reaches a prescribed maximum number.

8 Claims, 17 Drawing Sheets

POWER SUPPLY

TIMER

TIMER UP SIGNAL

PRINTING SIGNAL

RECOVERY SIGNAL

AC POWER SUPPLY

PRINT SELECT SW

INTERVAL DETECTION SIGNAL

PRINTING SIGNAL

RECOVERY SIGNAL

POWER SUPPLY

PRINT SELECT SW

TIMER

TIMER UP SIGNAL

PRINTING SIGNAL

RECOVERY SIGNAL

INKJET HAVING RECOVERY SYSTEM CONTROL METHOD AND APPARATUS OPERATING DURING PERIODS OF NON-USE

BACKGROUND OF THE INVENTION

1. Field of the Invention

The present invention generally relates to ink-jet printers and methods of controlling electronic systems which use such printers, and more particularly to a method and apparatus for recovering ink flow quality in an ink-jet type print head.

2. Related Technical Art

Ink-jet type printers are finding increasing use because of such advantages as low noise during printing, compact lightweight devices, and low power consumption.

However, when ink-jet printers remain in a non-operating or non-operational state or condition for an extended period of time, solvent evaporation and other effects cause the viscosity of any ink residing in the print head nozzles to increase. This results in inadequate ink discharge whenever printing resumes. Even if the increased viscosity does not cause improperly directed discharge of the ink, the amount of ink discharged may be less than normal, resulting in ink dots of differing diameters being output during printing and degrading print or output quality.

Some representative examples of techniques employed in the art in an attempt to solve these ink-jet printer related problems are disclosed in Japanese Published Patent application 61-56109 and U.S. Pat. No. 4,558,332. In both of theses patents, a method is used in which subsequent printing operations are first proceeded by detecting a prescribed period of non-operation or a time period over which discharge was interrupted and performing extra ink discharge, blank discharge, or other types of recovery.

However, as shown in these examples, printing typically has to be interrupted or the recovery process performed immediately prior to actual printing, which lengthens printing time and effectively slows down the printing speed. Also, if a printer user forgets to power down the printer mechanism, or the period of non-operation becomes extended through non-use, the amount of ink consumed as part of recovery processing unavoidably increases, which also increases power consumption and decreases efficiency. A further problem with the latter example is that, recovery is performed only prior to a subsequent printing operation even if a prescribed period of non-operation is exceeded, so that the ink viscosity in the nozzles increases even further, and recovering a desired ink discharge quality, which is the purpose of using a single recovery operation of a few discharge cycles, can not be achieved. That is, an extended period of non-operation causes the nozzles to become clogged while waiting for a recovery operation, and normal recovery is insufficient to recover the proper use of the ink-jet head.

As seen above, there are still problems in the art in trying to satisfy demands for high speed, high efficiency, and high reliability in ink-jet printers and printing mechanisms. What is needed is a new method and apparatus for solving these problems.

SUMMARY

In view of the above and other problems in the art, one purpose of the present invention is to provide a method and apparatus for achieving a highly reliable ink-jet printer offering extended ink-jet head life, efficiency, and reliability.

An advantage of the invention is that it provides consistent ink discharge without decreasing the effective printing speed.

These and other purposes, objects, and advantages are realized in an on-demand ink-jet printer mechanism equipped with an ink-jet head, a timer that measures preselected time periods, and a recovery device that performs recovery processing for ink-jet nozzles by discharging ink from essentially all of the nozzles used for printing, and in which the recovery device executes such recovery processing at intervals based on periods of non-operation of the ink-jet head that exceed time periods measured by the timer. In addition, the total number of times ink is discharged is also based on the time periods being measured by the timer.

The invention further applies to electronic systems and desk calculators which employ ink-jet printer mechanisms with on-demand ink-jet heads and that use a clock or timer for measuring time intervals. In such applications, an interval detector is used to detect the passage of a preselected time interval using the built in clock and a recovery processor is used to cause ink to be discharged by the nozzles in the ink-jet head at preselected intervals which are based on the time measured by the interval detector during non-operation of the ink-jet head.

In further aspects of this embodiment, the electronic system can use an AC power source, or even a battery, as a main power source and a battery as a subordinate power source, separate from the main power source, and the system clock uses the battery as a power source. A timer is used to measure the preselected time intervals and outputs timer information or signals indicative of such measurements. A power source controller is used to selectively switch off or disconnect the main power source when it is determined that the electronic system has not been used for a predetermined period of time. The recovery processor executes recovery processing at prescribed intervals measured by the timer during periods of non-operation for the ink-jet head, while the power source controller disconnects the main power source from the head in response to a preselected minimum amount of elapsed non-operating time for the ink-jet head as measured by the timer.

The invention also employs a control method for an ink-jet head in a printer mechanism having an on-demand type ink-jet head with a plurality of nozzles. The control method functions to discharge a predetermined amount of ink to recover a desired characteristic for the nozzles, and does so at preselected intervals during periods of non-operation for the ink-jet head.

In using the invention, ink whose viscosity has increased due to evaporation of the ink solvent, etc., within a fixed period is ejected from the ink-jet head by recovery operations which are performed at fixed intervals that are determined by the timer and controller, whereby the ink viscosity or concentration in the nozzles is maintained substantially constant. By maintaining a constant viscosity or concentration for the discharged ink, the quantity or speed of ink discharged from the nozzles, and the reflectivity of the ink on the recording medium remain consistent. Additionally, the total number of ink discharges used at any interval can be based on the measured intervals to provide improved response to extended periods of non-use. Therefore, reliable, consistent ink discharge can be achieved during printing, making print quality consistent and facilitating highly reliable printing.

Also, since recovery is performed while printing is not being performed, recovery need not be performed immediately before a printing instruction or during a printing operation, thus shortening the time required for printing and increasing the effective printing speed.

Furthermore, when the printing mechanism remains unused for extended periods of time, power to the mechanism, or ink pressurizing elements, is disconnected, thereby conserving power and ink used in operations, or recovery processing, unrelated to printing. Since recovery processing is performed when the power source is subsequently activated or reconnected to the printer mechanism, consistent ink discharge rates and quantities, which are required for high quality printing, are achieved while also conserving power and ink, thus providing high efficiency.

BRIEF DESCRIPTION OF THE DRAWINGS

The novel features of the invention may be better understood from a review of the following description when taken in conjunction with the accompanying drawings, in which like numbers refer to like parts and in which.

DETAILED DESCRIPTION OF PREFERRED EMBODIMENTS

An example of an ink-jet printer as typically used with the present invention is explained below first in relation to FIG. 16.

Figure 16:
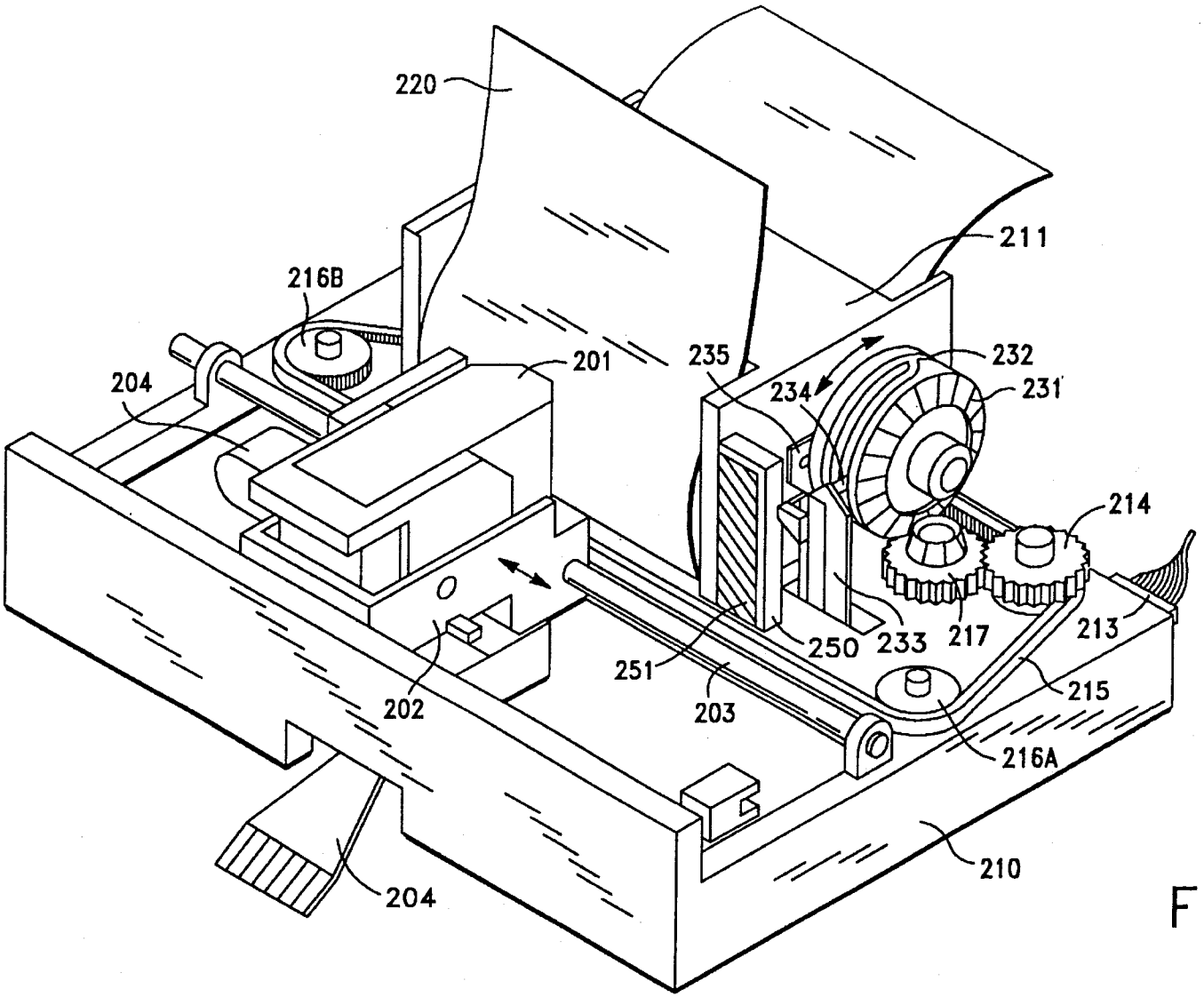
FIG. 16 illustrates a perspective view of one embodiment of an ink-jet printer useful for implementing the invention.

A perspective view of an ink-jet type printer for which the present invention is useful is presented in FIG. 16. As shown in FIG. 16, a typical ink-jet printer employs an ink-jet head 201, mounted on a carriage 202, which is supported by a carriage shaft 203, along which it is moved back and forth, adjacent to a recording or printing medium such as paper 220. Medium 220 is further supported or guided by a paper guide 211 which is in turn supported by a printer frame 210 which acts as structural support for the entire printer. A flexible printed circuit (FPC) 204 transfers drive signals to ink-jet head 201, while a lead wire and connector assembly 213 is used to input drive signals to the printer motor (not shown). A motor gear 214 transmits rotation of the motor through a timing belt 215 which engages carriage 202 and meshes with motor gear 214 so as to drive carriage 202. A pair of pulleys 216A and 216B help properly tension and guide timing belt 215 as it moves across frame 210.

Ink-jet head 201 is mounted on carriage 202 and is scanned or reciprocated laterally across paper 220, as in a horizontal row but transverse to vertical columns, in response to movement of timing belt 215 by the motor. Formation of characters, graphical forms, and other information on paper 220 is accomplished by printing dots which are formed by selectively driving one or more desired nozzles, from a series of such nozzles, in ink-jet head 201. Nozzle activation is accomplished using a signal which is synchronized with the motor control or drive signal.

A paper feed gear 231 is a generally cylindrical gear with a bevel-shaped surface that interacts with gear 214, through one or more intermediate gears, and transfers rotary power needed for feeding paper. A paper feed switching cam 232 is formed on one cylindrical surface of paper feed gear 231 for switching or selecting the amount of driving force to be used for feeding paper. A transmission gear 217 is used to transmit motor drive force from motor gear 214 to paper feed gear 231. A switching lever 233 has a cam follower 234 on one end that engages paper feed switching cam 232, while a paper feed power transmission lever 235 extracts power for paper feeding from another cylindrical surface of paper feed gear 231. Transmission lever 235 is configured so that it engages switching lever 233 and applies a prescribed paper feeding force to a paper feed roller (not shown) in synchronization with the reciprocating action of print head carriage 202.

An ink holder 250 is mounted on frame 210 adjacent to paper guide 211 and houses an ink absorber 251 which is made from foam rubber or other porous material. Ink absorber 251 is positioned in the path of ink head 201 and acts as a receptacle for ink during recovery processing, during which prescribed amounts of ink are discharged through the nozzles in the ink-jet head to prevent clogging. Ink holder 250 is mounted on frame 210 in a manner that prevents ink from leaking outside of the printer even if the absorber absorbs a significant amount of ink.

During the recovery operation, carriage 202 is moved by the motor via timing belt 215 until the nozzles on ink-jet head 201 are positioned opposite to ink holder 250. Ink ejected during any recovery operation is effectively absorbed and retained by ink absorber 251. A typical recovery operation consists of implementing a fixed or preselected number of ink discharges for each nozzle being recovered.

That is, one recovery operation or recovery cycle comprises a series of nozzle discharges or discharge cycles per nozzle to remove a certain amount of ink.

It is also possible to use a configuration in which a cap for covering the nozzles is disposed next to ink holder 250 and prevents the ink viscosity from increasing or the nozzles from clogging during periods of long-term non-use to such an extent that they cannot be recovered by some type of control device and recovery processing.

The relationship between certain chemical characteristics of the ink-jet ink typically used in the ink-jet printer and recovery processing steps are described next.

Figure 17:
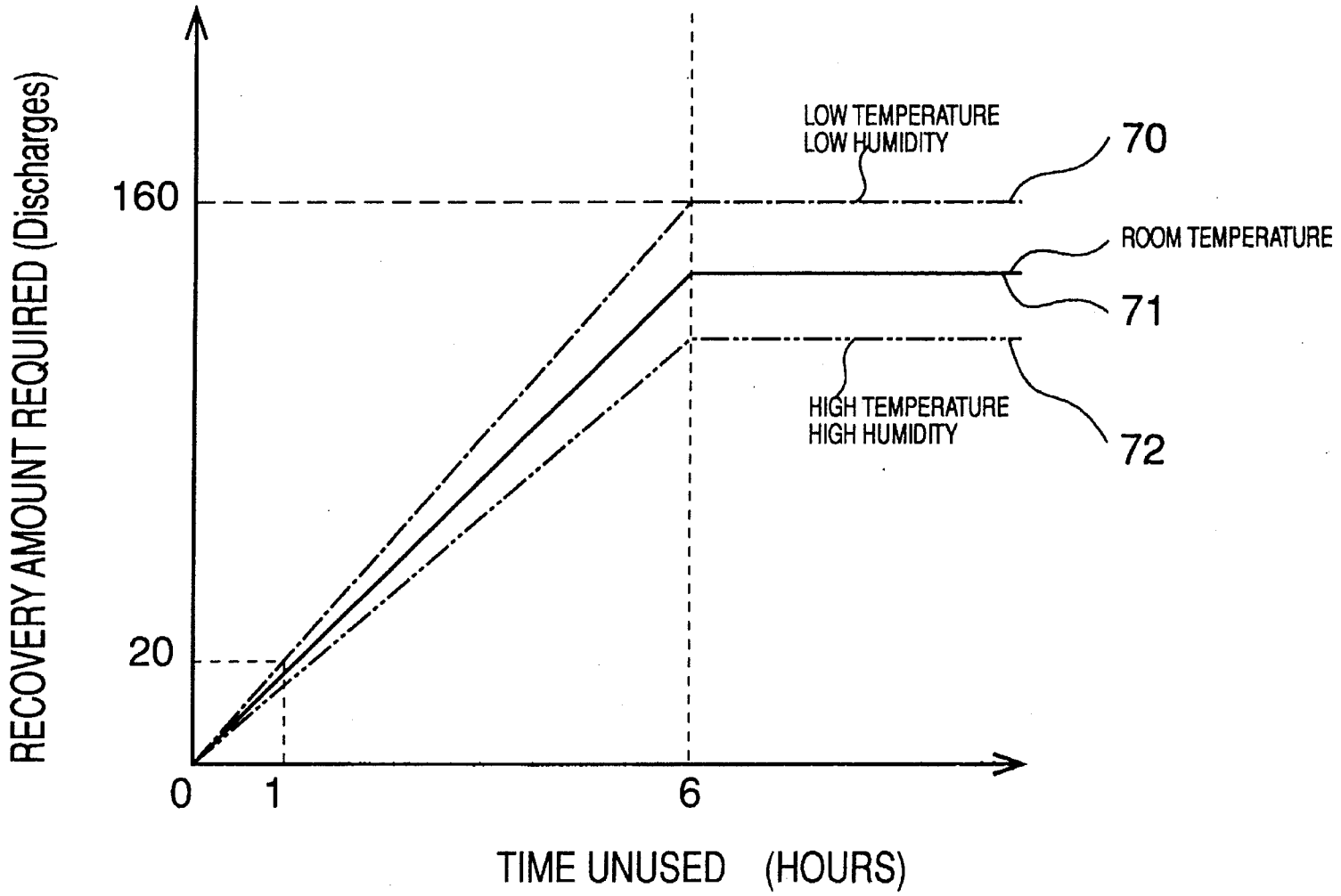
FIG. 17 illustrates a graph of the relationship between the minimum number of ink discharges required for recovery of the ink-jet head used in the invention and the length of non-use.

The relationship between a minimum required recovery processing amount, or number of discharges, (indicated by the vertical axis) for recovering the ink-jet head used in the invention and non-printing time (horizontal axis) due to periods of non-use, etc. is presented in graphical form in FIG. 17. The ink used in the invention has as its main components ethylene glycol, water and dye, and because it contains ethylene glycol, the lower the temperature the greater the ink viscosity, or because water or other solvents evaporates, the ink viscosity increases the longer the ink remains sitting. This is explained in more detail below.

Non-printing time, that period of time during which the printer is left unused or in a state of non-use, and recovery processing, the number of times ink is discharged from the print head nozzles, demonstrate a roughly proportional relationship over a relatively short time period, that is, for periods of less than six hours, as shown in the figure. If the time-up or expiration time of the timer that measures non-printing time from the previous ink discharge is set at a relatively long period, it is necessary to increase the number of discharges or recovery amount, while if that time is set short, it is possible to use a small total number of ink discharges. This proportional relationship is determined by physical or chemical characteristics of the ink-jet head or the ink used and also by such environmental conditions as temperature and humidity.

The relationship between the period of non-use and the necessary recovery activity for low temperature and low humidity (5° C. and 35%) is indicated by a single-dashed line 70 in FIG. 17, while the relationship for room temperature (25° C. and 60%) is indicated by a solid line 71, and for high temperature and high humidity (40° C. and 95%) by a double-dashed line 72. The number of discharges used in recovery processing for long periods, say of more than six hours, requires a relatively large number of nozzle discharges, on the order of 100 or 200 discharges, and is roughly fixed irrespective of the actual length of time unused. This is a result of the fact that nearly all of the ink in the nozzle pathways in the ink-jet head need only be discharged and replaced with new ink after six or more hours have passed. In this case, the number of discharges required for full recovery of print quality is determined by the volume of ink occupying the nozzle pathways of the ink-jet head, which is determined by ink-jet head physical operating parameters and remains constant, rather than the time required for the viscosity of the ink in the nozzles to increase.

Therefore, the number of discharges in recovery processing is a relatively large fixed number which is unrelated to the length of non-use, for long periods of non-use. At the same time, the maximum value for the minimum times of discharging required is determined by this number and is unrelated to the length of non-use, and if the recovery amount is greater than this determined ink discharge amount, then consistently good, reliable ink discharge, and high printing quality can be achieved. In actual use, ink typically begins to harden gradually after six hours due to the effects of drying, etc., and if left for longer periods on the order of several months, recovery must generally be performed using some physical method of cleaning the nozzles. To prevent this problem, the ink-jet head is made removable so that it can be stored in an air-tight container when not used for extended periods. Alternately, a capping mechanism can be provided for the head and attached to the printer.

According to FIG. 17, a maximum amount of time the print head can remain unused and still be recovered by a given pressure generation device can be determined once the number of discharges, is fixed. That is, assuming the number of recovery discharges is set at a value such as 10, then the maximum recoverable unused time is approximately 30 minutes.

In this embodiment of the invention, the number of discharges performed when power is first applied is used as a maximum value or limit (here 160 discharges) for the required minimum amount for recovery.

The purpose of the invention is to take full advantage of the physical characteristics of the ink and is explained in further detail below in relationshAp to the remaining figures. In all of the figures, similar numbers indicate similar components.

Figure 15:
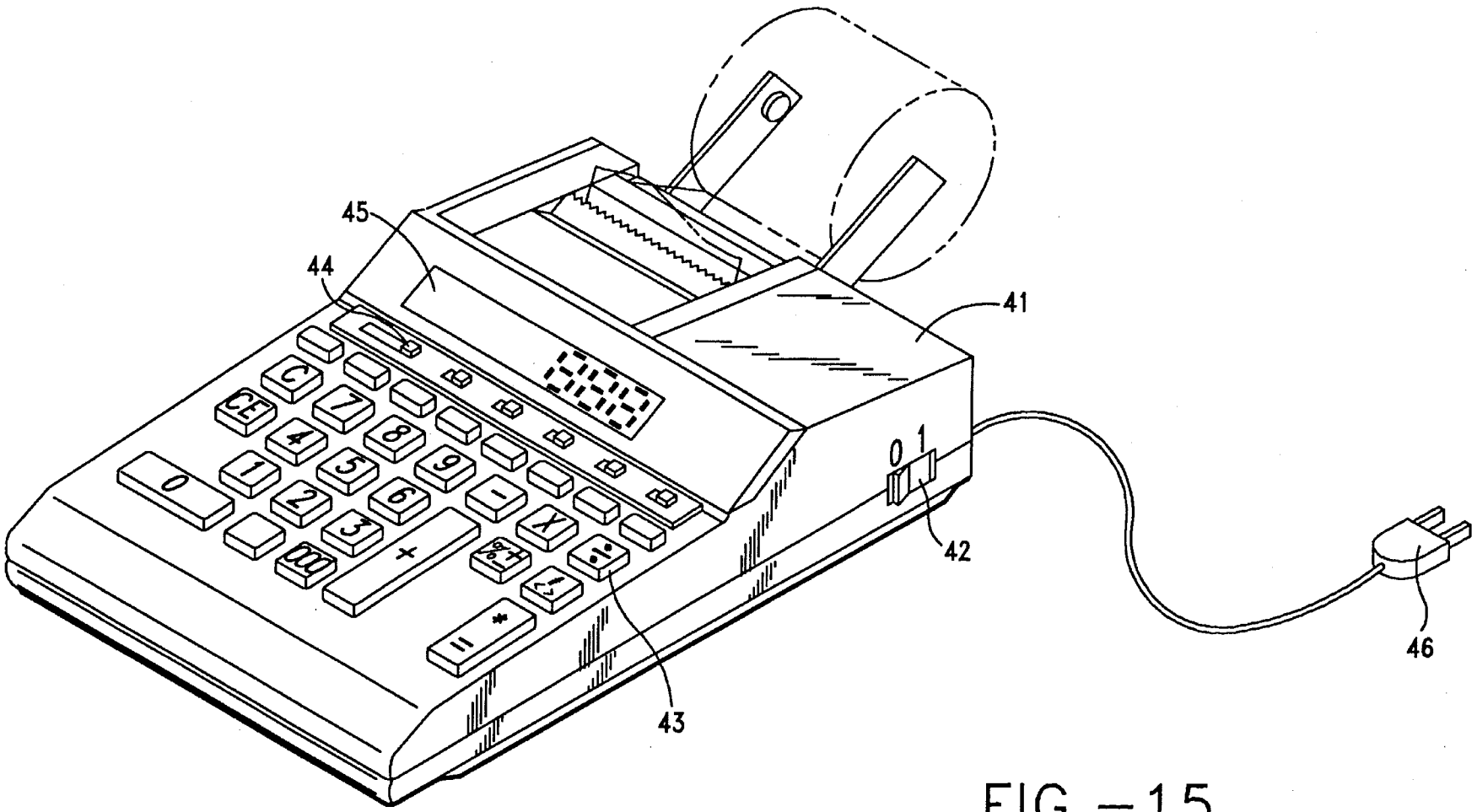
FIG. 15 illustrates an external view of one type of electronic desk calculator type of electronic system in which the inventive ink-jet printer is used.

FIG. 15 illustrates an external view of one type of electronic desk calculator (calculator below) which is the type of electronic system on which the ink-jet printer of the present invention is used. In FIG. 15, a calculator case 41 supports a power switch 42, a keyboard 43, a print selector switch 44 for selecting use of the printer, a type of liquid crystal display panel 45 which serves as an output display device, and a power plug 46 for use with an AC power source. Even if power switch 42 is placed in the on position, printing is not executed unless the print selector switch is also turned on or placed in the appropriate selection position. Until the printer is selected, the calculation results, etc., are only displayed on liquid crystal display panel 45.

Figure 2:
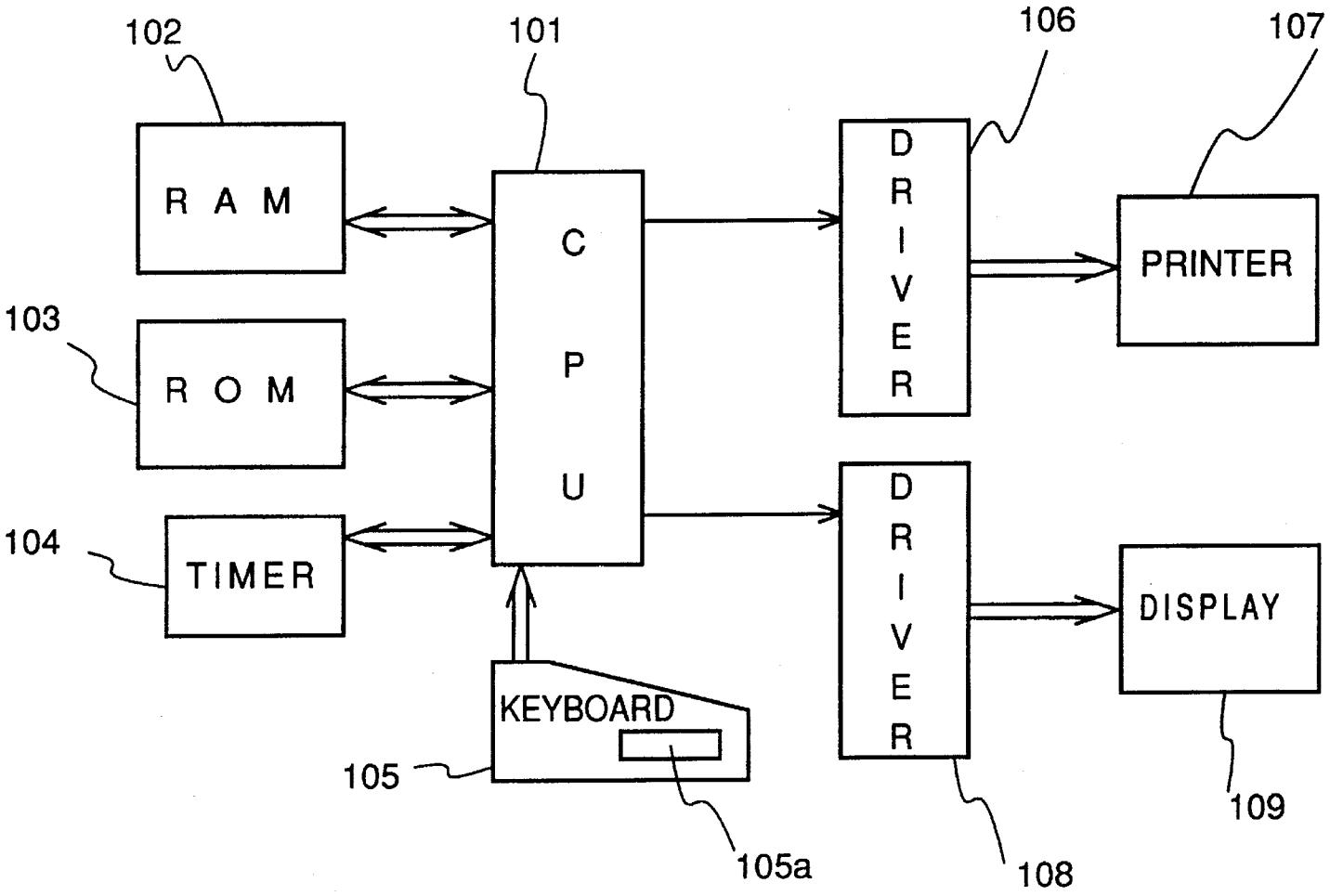
FIG. 2 illustrates a block diagram of one type of electronic calculator system for which the ink-jet printer of the invention is useful.

A block diagram of one type of electronic calculator system useful with one embodiment of the ink-jet printer of the invention is shown in FIG. 2. In FIG. 2, a central processing unit (CPU) 101 is shown which controls the entire calculator, a RAM 102 is used for temporarily storing data being processed, a ROM 103 is used to store a program or programs or data, such as preselected values of times counted by a timer or other predetermined values, and a timer 104 is used as the timing device for measuring time. Also shown in FIG. 2, a keyboard 105 is used for data input, an ink-jet printer 107 is employed with a printer driver unit 106, a liquid crystal display 109 serves as a display device for displaying calculation results, and a display driver unit 108 drives liquid crystal display 109. A print selector switch 105a selects whether or not calculation results are to be printed, and is typically disposed within the keyboard. Timer 104 is configured to allow CPU 101 to measure time and is mainly used in a form of time management to prevent dogging of the nozzles in the ink-jet head of the printer.

CPU 101 processes input from the keyboard, etc., according to routines forming portions of a program stored in ROM 103, and transfers output data to printer 107 through driver unit 106 as required, which drives and controls printer 107. The data input from keyboard 105 may be temporarily stored in a keyboard buffer or other memory device.

Generally, a programmable timer is used to implement timer 104, in which a preselected time is set or programmed by CPU 101. Timer 104 either measures the preselected, programmed, time or counts a prescribed number of clock pulses which is equivalent to the preselected time interval. Timer 104 is reset by an initialization signal provided by CPU 101, and starts measuring time. After expiration of the preselected time interval, or the set time has been measured, timer 104 is normally reset and commences counting again. Timer 104 may be built into CPU 101 or may comprise an external structure such as an independent integrated circuit type timer which is interfaced to the CPU. Timer 104 may employ several alternative structures known to those skilled in the art for establishing the desired timing interval such as, but not limited to, a device that measures time based on charge or discharge rates for a capacitive element. A re-triggerable type of timer capable of restarting counting in response to a reset signal received during current counting operation is desirable.

Figure 1:
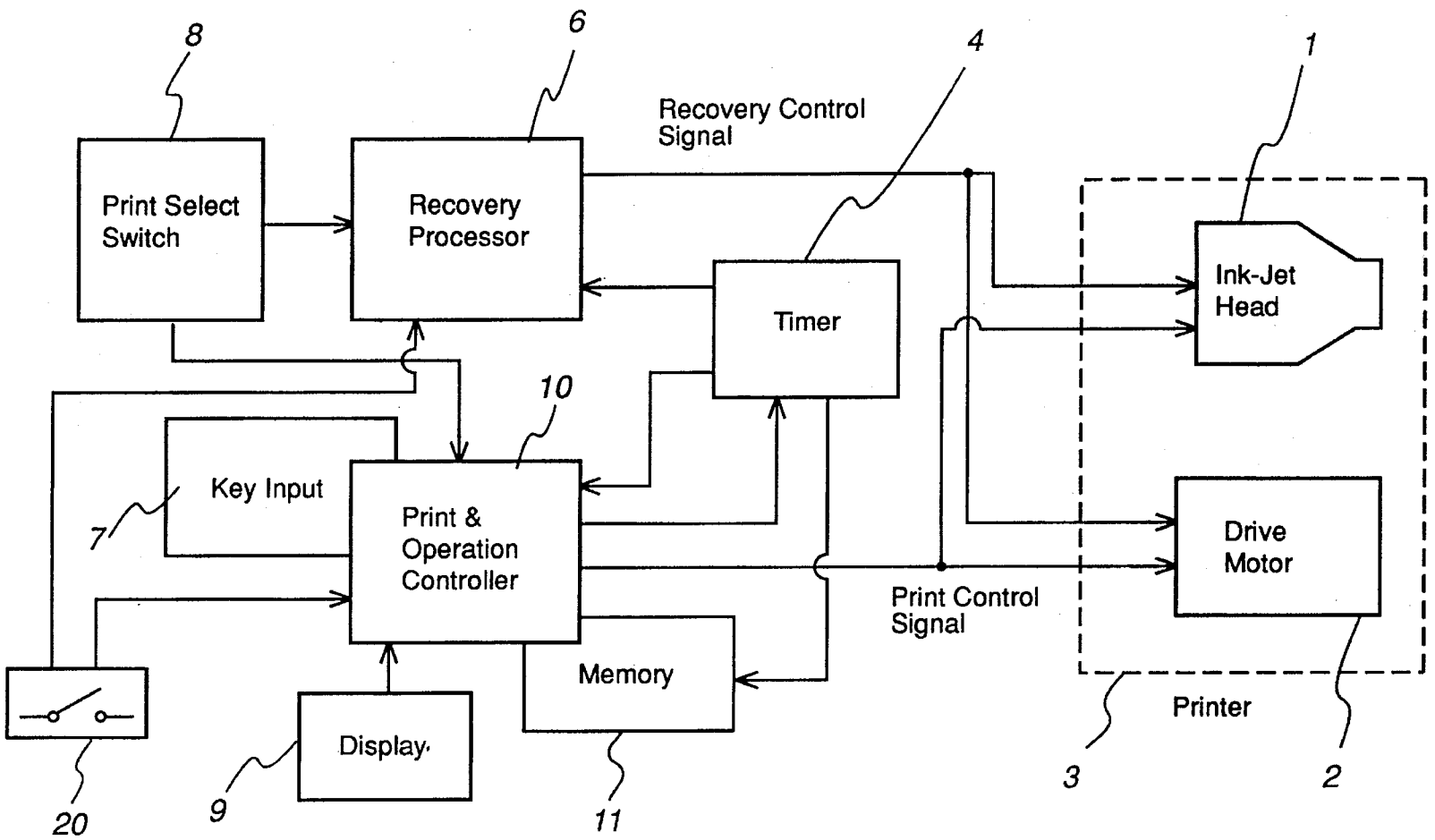
FIG. 1 illustrates a functional configuration for one embodiment of the invention.

FIG. 1 represents a functional diagram of one embodiment of the invention. In FIG. 1, a power switch 20 facilities operation of the calculator, and as one example an AC power source is used as the driving power source and a DC regulator is connected to the power source. An ink-jet head 1, is used which has nozzles and pressure generation elements which function to discharge ink drops from the nozzles. A drive motor 2 operates to move or reciprocate ink-jet head 1, as discussed above, and to advance paper or other printing media adjacent to the head. Ink-jet head 1 and drive motor 2 are the principal components that make up printer 3. The printer prints characters and images by discharging ink drops from ink-jet head 1 so that they strike the printing medium while ink-jet head 1 or the printing medium are moved relative to each other using drive motor 2. A timer 4 measures preselected periods or intervals of time. A recovery or recovery processing controller 6 controls the steps used in implementing recovery processing for ink-jet head 1. A print and operation controller 10 provides control over printing operations, receives and controls key input from key input elements 7, controls display on display 9, which is typically a liquid crystal panel, etc., and provides the initialization signal for initializing timer 4.

A memory structure or element 11 is connected to and used by print and operation controller 10 as a temporary or transient storage device. Memory 11 is typically used to store timing information such as the number of times timer 4 has reached the expiration of the preselected time interval, the preselected interval length, calculation data, etc.

In response to key-type input from key input elements 7, print operation controller 10 executes one or more prescribed calculations or procedures associated with calculator operations assigned to such input. Print and operation controller 10 also exerts control over display 9 so that certain intervening input values, operations, and final results for calculations are visually presented on the display. A print selector switch 8 located on the keyboard selects whether or not any part of the calculation process, such as input values or results, should also, or in the alternative solely, be output to the printer. If print selector switch 8 is in an on, or printing selected, position, print and operation controller 10 also provides one or more print control signals that operate and control ink-jet head 1 and drive motor 2, resulting in output by the printer.

However, since there is often a strong possibility that the printer has not been used for a long time when the print selector switch on the keyboard is changed to select the printer, recovery controller 6 is operated at that time to perform recovery processing by controlling ink-jet head 1 and drive motor 2. The timing condition or state of timer 4 can be checked at this time, and if recovery processing was executed when the electronic device's power source was activated or powered on, then execution of recovery processing can be delayed until the preselected time has elapsed after printer mechanism activation. In either case, a change of state for power switch 20 or print selector switch 8 definitely activates recovery processing.

Timer 4 is reset whenever recovery operation or processing occurs. Timer 4 measures a preselected or predetermined time period, based on known ink characteristics and parameters, and transfers the resulting timer information to recovery controller 6. Recovery controller 6 performs recovery operations by controlling activation of nozzles in, and lateral movement of, ink-jet head 1 and drive motor 2 using one or more recovery processing signals which are based on the information provided by timer 4. Since recovery is generally executed by moving the print head carriage laterally to the location of the ink absorber prior to discharging any ink form the nozzles, the drive motor must be appropriately controlled to achieve the proper movement.

However, ink can be simply discharged onto the recording paper during recovery, after which paper feeding or advance is performed, and the used paper discarded. In this situation, the drive motor need not be operated or controlled since ink discharged during recovery operations is not placed in a location on the paper which is mixed with the normally desired printing output.

Figure 3A:
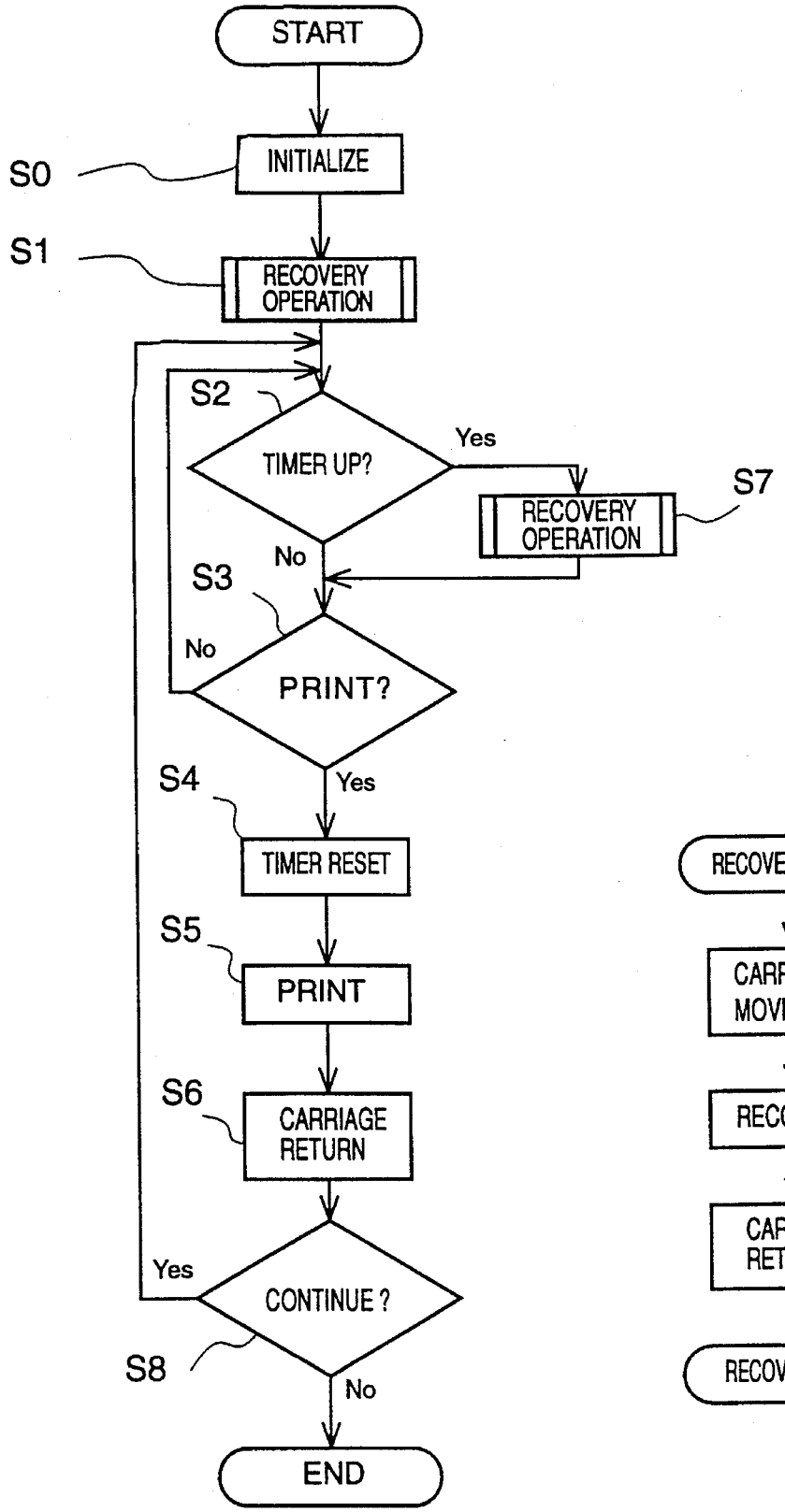
FIG. 3A illustrates a flowchart of a control method for the ink-jet printer of the invention.
Figure 3B:
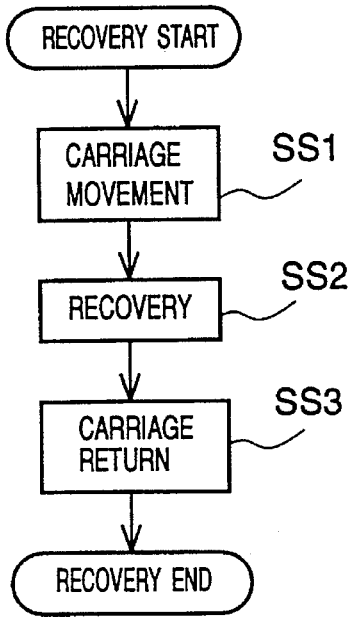
FIG. 3B illustrates a flow chart of a recovery substitute thereof.

A flowchart of one control method for an ink-jet printer operating according to the principles of the invention in an application having no print selector switch is shown in FIGS. 3A and 3B. FIG. 3A depicts a main routine while indicates a sub-routine thereof.

Referring to FIG. 1, FIG. 3B depicts in a step S0, any circuits, printer mechanism, etc., are first initialized. Timer 104 is reset at the same time and begins counting or measuring the passage of time. Recovery operations or processing is performed immediately after the source of power is powered-on or power is applied to the printing mechanism, in a step S1. With reference to FIG. 3B steps involved in the recovery operation are indicated by steps SS1 to SS4 of recovery operation sub-routine, where a series of operations used to achieve ink-jet head recovery are shown. In step SS2, the carriage on which the ink-jet head is mounted is moved from a standby position to an ink holder that houses the ink absorber. Next, recovery is performed in a step SS3 to remove ink present in the nozzles of the ink-jet head whose viscosity has increased, or other poor quality ink that may cause improper ink discharge from the nozzles. Recovery is achieved by discharging ink a prescribed number of times from all of the nozzles by driving pressure generating elements associated with each of the nozzles. Normally, 10 to 200 discharges are performed per nozzle to eject undesirable ink, ink whose viscosity has increased. The number of discharges performed during recovery is determined by the amount of time set in timer 104. At the completion of the recovery operations or procedure, the print head carriage is returned to a standby position in step SS4, thus completing the series of recovery operations.

Since there is often a strong possibility that the print head has not been used for an extended time whenever the power source is powered on, 160 to 200 ink discharges are executed as part of an automatic recovery procedure at that time. This number of discharges represents a maximum number of discharges which are found to be practically capable of recovering printing quality for a print head. As discussed further below, if this is not sufficient, then alternative mechanical cleaning techniques are generally required to recover use of the print head.

Upon completion of a recovery operation, timer 104 begins measuring a preselected or predefined time interval. In step S2, a determination is made as to whether or not a "time-up" or "expiration" signal has been generated by timer 104 to determine whether the timer has measured the preselected time. When the time-up signal has been generated as an output of timer 104, processing advances to a step S7 where the recovery operation indicated by the recovery operation sub-routine is performed, and then processing advances to a step S3. If there no time-up signal is detected in step S2, then processing advances instead to step S3. In step S3, a determination is made as to whether or not printing is to be performed.

If printing is not to be performed at this time, then processing returns to step S2. Otherwise, timer 104 is reset in step S4 and printing is executed in a step S5. The print head carriage is returned to the standby position in a step S6 and a determination is made as to whether or not printing is to be continued in a step S8, after which processing returns to step S2 if printing is to be continued. Otherwise, printing is terminated and processing ends.

In this embodiment of the invention, recovery operations are first performed immediately after power is applied to the printer, and subsequently at prescribed time intervals provided printing does not occur. Also, since recovery processing is executed once when power is first applied, the number of recovery operations or cycles performed before the printer is used for actual printing can be completed in a very short period and kept to a small number, thus keeping the waiting time short.

If the number of ink nozzle discharges performed when power is applied is set as described above, recovery can be reliably performed at the time of powering on regardless of the extent or length of non-use, making it possible to consistently achieve good printing quality. Reliability can further be enhanced by including a capping mechanism for the nozzles.

Figures 4A, 4B, 4C, 4D, 4E:
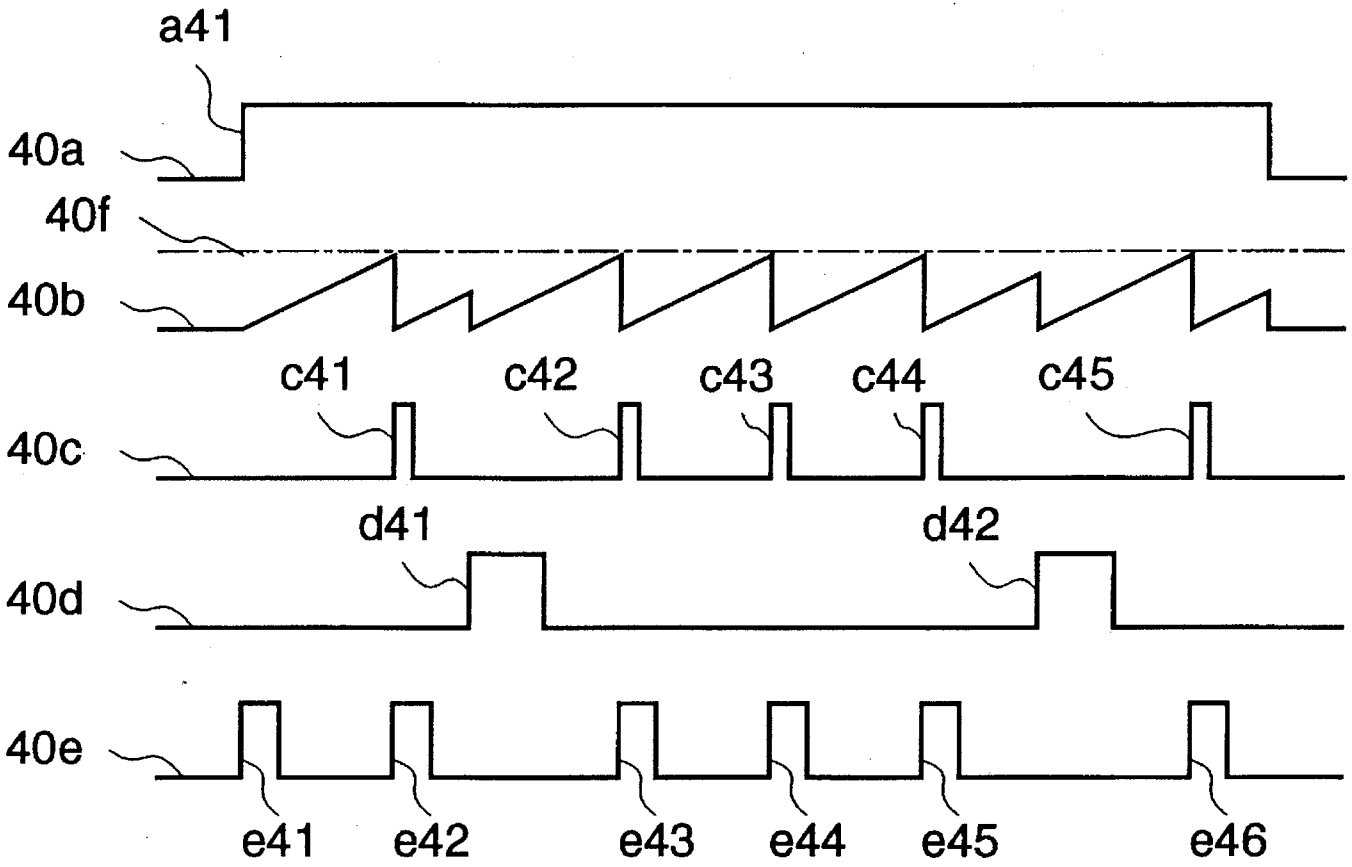
FIGS. 4A–E illustrate timing charts for the control method of FIG. 3.

Timing charts describing the operation of the embodiment shown in FIG. 3 are shown next in FIGS. 4A–4E. In FIG. 4A, the operating state or condition of the printer power source is indicated by the timing signal or waveform **40*a* while waveform 40*b* represents the count or counting status of the timer over time. A single-dashed line 40*f* in FIG. 4B indicates the time or count value (vertical axis) for which the expiration or time-up point is reached in timer signal 40*b* when counting at some predefined rate. This, then, is the preselected value for the period of non-use discussed above, or the number of clock pulses measured by timer signal 40*b*** which corresponds to the selected time.

When the timing interval represented by reaching expiration count **40*f* is relatively short, more ink is consumed than necessary. Therefore, count 40*f* is normally set lower to make the expiration time shorter than the time required for ink in the nozzles of the ink-jet head to become so viscous as to not allow recovery but longer (larger) than the normal operating time of the system. In this embodiment, a preselected time period of 30 minutes is used to define when the time-up point is reached, and the number of discharges accomplished per nozzle is set at 10. Therefore, the count value for 40*f*** is set according to the number of clock cycles that occur in a 30 minute period.

In FIG. 4, a waveform **40*c* represents the time-up signal being output by the timer with pulses occurring whenever the preselected count is reached or the preselected time interval has expired, that is, the "time-up" condition is obtained. Waveform 40*d* also indicates an exemplary printing signal and waveform 40*e* an exemplary recovery signal. After powering on at a time indicated by a transition or pulse a41, recovery operations are performed in response to the signal pulse e41 which occurs in recovery signal 40*e*, and since no printing is indicated by signal 40*d* at this point and printing is not performed within the prescribed time period by which the timer reaches the specified count value 40*f*, the timer output signal 40*c* generates a pulse c41 indicating expiration of the selected interval or that the time-up condition is met. In response to the expiration of time indication provided by pulse c41, recovery is executed by outputting a signal transition or pulse e42 from the recovery controller. A signal pulse d41 is provided in printing signal 40d which controls or engages printing immediately after recovery point e42, and resets the timer at the beginning of printing. If no printing is specified by signal 40*d* for an extended period following this printing and reset operation, then recovery operation pulses e43, e44, e45 are output in response to time-up signal pulses c42, c43, c44 which occur as the timer, 40*b*, obtains the count value 40*f***.

To reset the timer using a printing signal, or signal associated with printing, may be accomplished using a signal generated at the beginning of printing for a series of data, or a signal generated once per line of printed data. While the above embodiment assumes a signal occurring at the beginning of printing, a printing termination signal that is issued at the completion of a printing operation may also be used. These signals may be selected or monitored, as desired, by processing routines executed by the CPU.

The embodiment described above provides the same results and benefits when implemented as part of an electronic desk calculator which employs an ink-jet printer as an output device.

Figure 5:
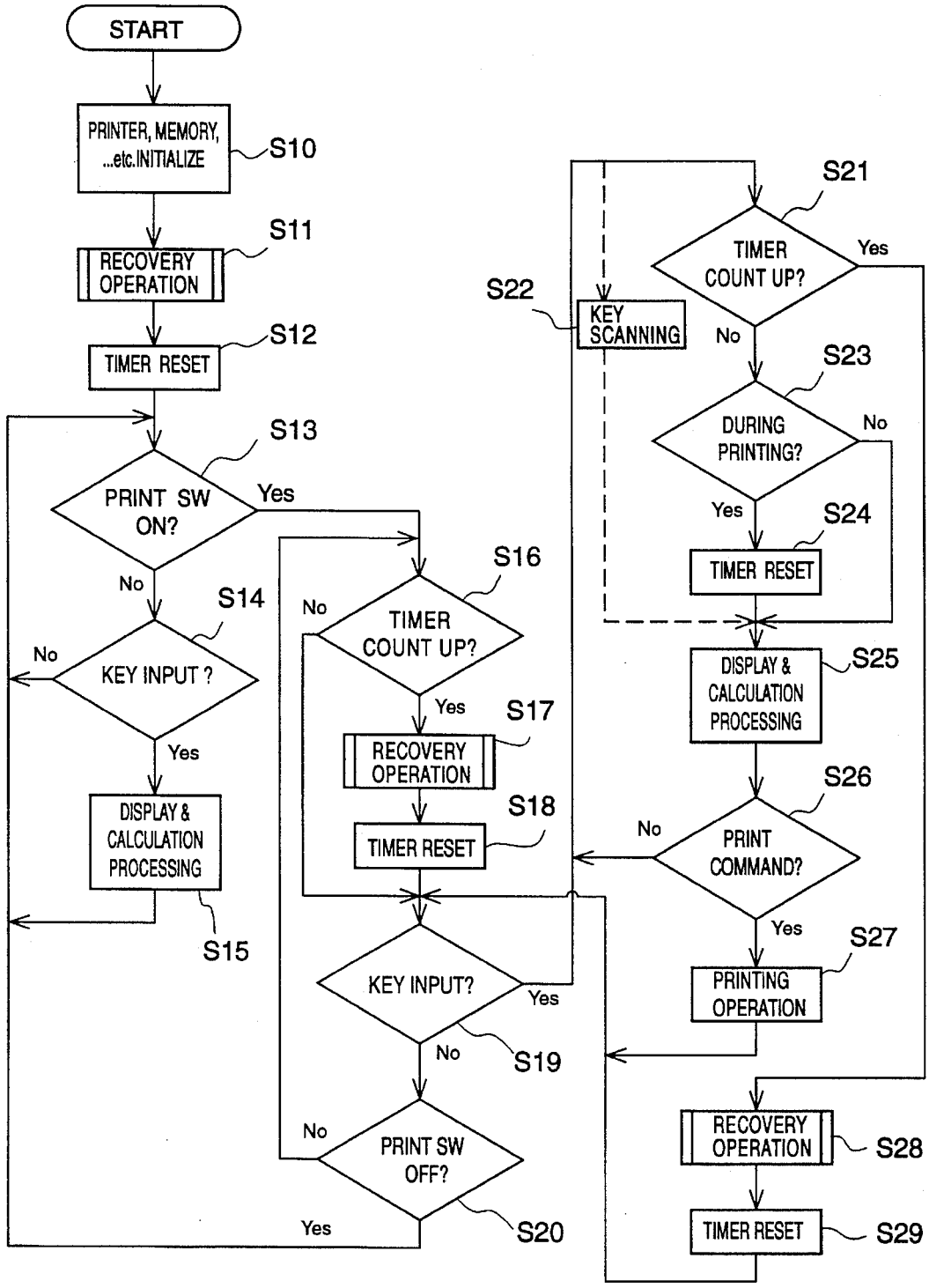
FIG. 5 illustrates a flowchart of an alternative control method for an electronic calculator and printer operating according to the invention.

A flow-chart for another control method useful for the calculator and printer of the invention is illustrated in FIG. 5. As before, the printer, memory, etc., are each first initialized immediately after application of power in a step S10. Next, in step S11, the initial recovery operation is performed. This recovery operation is indicated by steps SS1 to SS4 of the recovery operation sub-routine in FIG. 3B. This recovery operation is executed when the power source is connected and power is applied, generally to the printing mechanism. Upon completion of the initial recovery operation, timer 104 is reset in a step S12 and begins measuring the specified time period that was selected. This time measurement is performed in order to determine the passage of the required minimum time for recovery and to measure time elapsed from that point. A determination is then made in a step S13 whether or not the print selector switch is positioned in an on position, and if not, then only key input detection (step S14) and various operations associated with the display of arithmetic, calculator routine processing (step S15) are executed. The timer continues to measure time during this period, and when the specified time elapses, the timer indicates that time is up and proceeds to measure the subsequent elapsed time.

Processing advances to a step S16 where confirmation of the print selector switch on position is performed, and the count value or counting status of the timer is also confirmed to determine if the preselected time, as measured from the initial recovery operation, has been exceeded. If the timer count indicates that the expiration time has been exceeded, then a recovery operation is performed in a step S17 and the timer is reset to begin measuring time again. In addition to the timer count, elapsed time is detected so as to select or control the number of discharge cycles performed based on the total elapsed time. This data is generally stored in a table in a ROM 103, and recovery controller 6 sets the number of recovery operations based on the data stored in ROM 103. The calculator waits for key input in a step S19, and once such input begins, processing advances to a step S21. Otherwise, in the absence of key input, processing advances to a confirmation step S20 where the position of the print selector switch position is detected, and if it is on, then the same routine as shown in steps S16 through S20 is repeated.

The timer status is confirmed in step S21 in synchronization with key input, and if the prescribed time has elapsed, then recovery and timer reset are executed in steps S28 and S29. If the timer has not finished counting-up, then processing advances to step S23, where a determination is made as to whether or not printing is being performed, and if printing is occurring, then the timer is reset in a step S24 and both display and arithmetic processing are executed in a step S25. While this processing is being performed, scanning of the keys is also executed in a step S22 and key input is enabled. If printing is not being performed, then the step that resets the timer is skipped and processing proceeds to step S25. In a step S26, key input is terminated and a determination made whether or not a print instruction has been generated, and if it has not, then key scanning step S22 and processing steps S21 through S25 are executed. On the other hand, if a print instruction has been generated, then print processing is executed in a step S27.

Figures 6A, 6B, 6C, 6D, 6E, 6F:
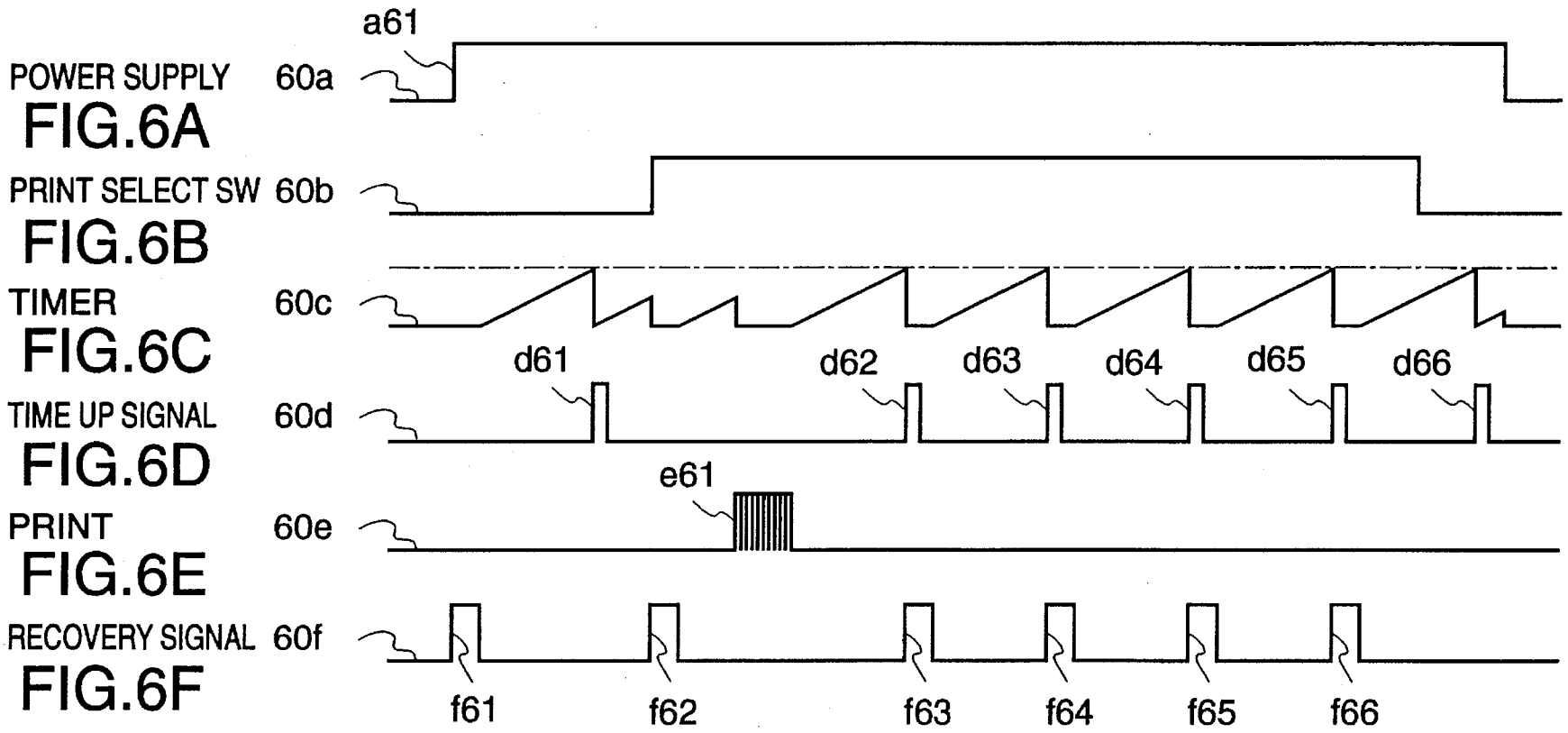
FIGS. 6A–6F illustrate timing charts for operation of the embodiment of FIG. 5.

Timing charts for operation of the embodiment of FIG. 5 are shown in FIG. 6. In FIG. 6A, a signal waveform 60*a* indicates the status of the power source or the connection and disconnection of power to the calculator, while a waveform 60*b* indicates the status of the print selector switch, with the higher value indicating an on condition, and 60*c* indicates the timer counting status. The maximum height of the peaks in signal 60*c* indicate the maximum or prescribed value for the number of clock pulses counted by the timer. A signal 60*d* indicates the timer output, and signals 60*e* and 60*f* printing and recovery timing signals, respectively. As before, to prevent unnecessary ink consumption, the prescribed expiration time or timing interval is preferably set at 30 minutes, and the number of discharges per nozzle is set at about 10.

After power is applied as indicated by signal transition a61, recovery is performed in response to signal transition f61 and a time-up signal pulse d61 is generated after the preselected time has elapsed and is stored in memory. Since the print selector switch is changed to the on position or state after the time-up pulse d61 as indicated by signal 60*b*, a recovery signal pulse f62 is executed to commence recovery operations. Printing is then immediately performed in response to a print signal pulse or series of pulses e61, and timing or timer counting is started almost the instant printing is terminated. This later event is seen in the alignment of the beginning of a counting slope in signal 60*c* with the termination of printing pulses e61. A signal generated whenever the print head carriage is reciprocated for changing print lines is used to reset the timer in the above embodiment, and the timer is continuously reset every time a new line is selected during printing. In this case, a retriggerable timer is used for the timer.

As before, each time one of time-up indication pulses d62, d63, d64, d65 are generated, recovery operations are performed in response to recovery pulses f63, f64, f65, f66.

Since the ink in the nozzles increases in viscosity when printing is not performed for extended periods of time, consistent ink discharge and superior printing quality can be achieved by performing recovery processing at each expiration of the preselected time interval as explained above.

Figure 7:
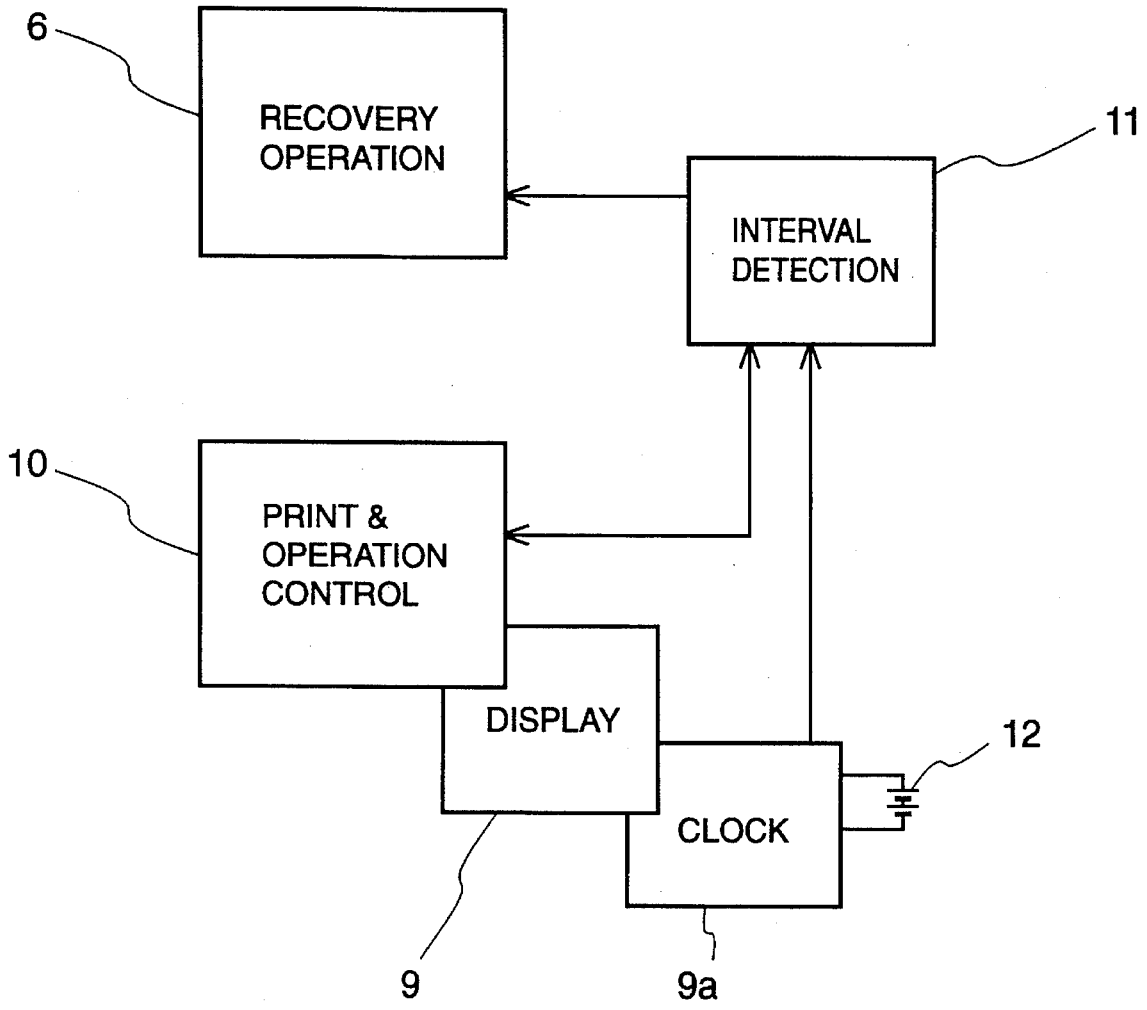
FIG. 7 illustrates a block diagram of another embodiment for an electronic system constructed according to the invention.

A block diagram of another embodiment of an electronic system using the invention is shown in FIG. 7 which also shows another configuration for timer 4 of FIG. 1. A clock 9*a* measures and displays time and is connected to a battery 12 which provides power separate from the main unit, and is configured such that it is driven independently. An interval detector 13, which detects the prescribed time intervals, is connected to clock 9*a*, and detects for example, 15-minute intervals, and transmits expiration of the prescribed time periods to recovery processing controller 6. The interval detector can easily output a detection signal at intervals of 15 minutes by determining the value assigned to the minutes unit in timer 9*a*.

Figure 8:
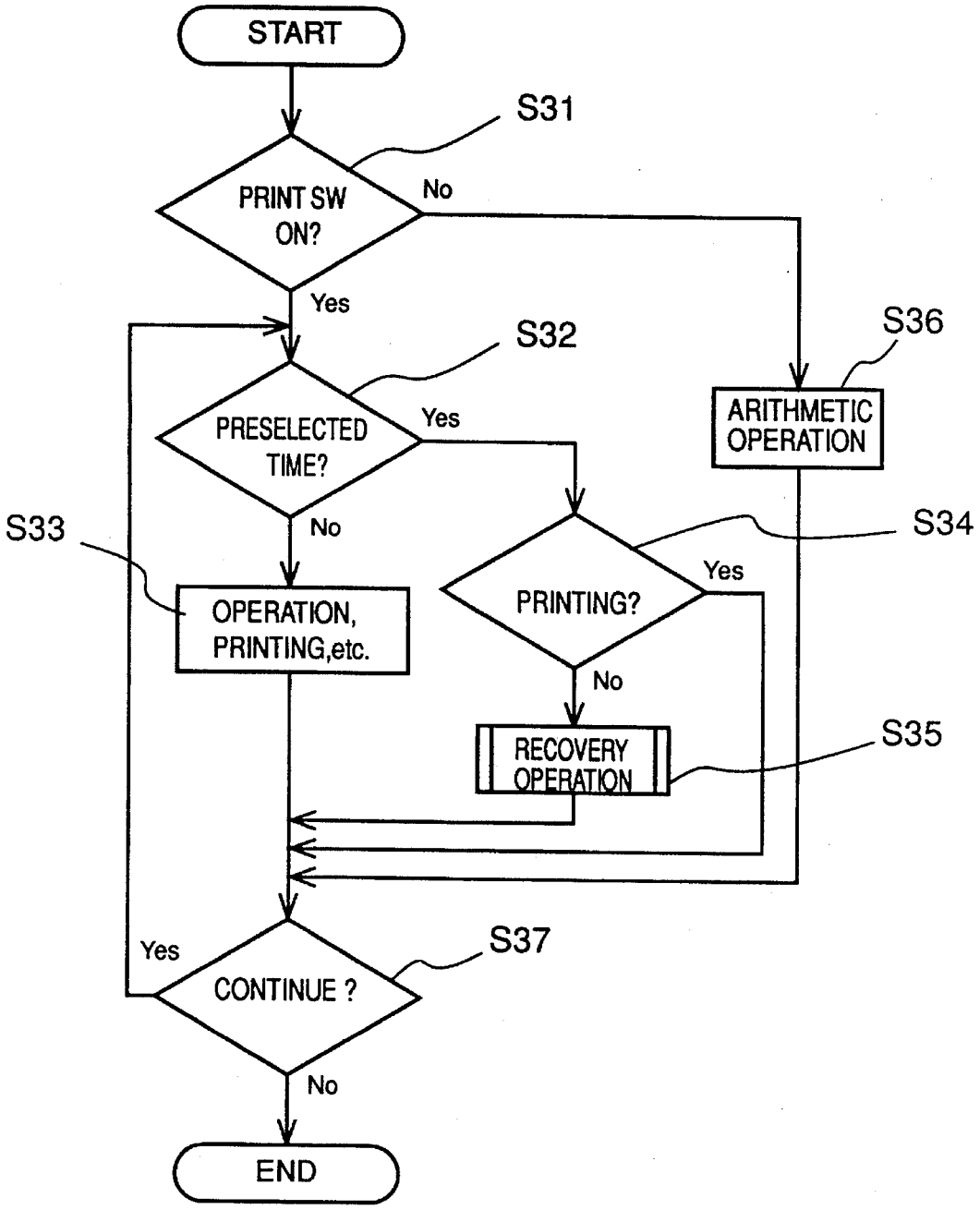
FIG. 8 illustrates a flowchart of a method of controlling the electronic system of FIG. 7.

A flowchart showing a control method for the electronic system in FIG. 7 is shown in further detail in FIG. 8. After the print select switch is placed in the on position in a step S31, the interval detector determines whether or not the clock time has reached 15, 30, 45 or 00 (for 60 min. intervals) minutes, etc., and if a prescribed time interval has been reached in a step S32. Processing then proceeds to step a S34 where a determination is made as to whether or not printing is being performed. If printing is being performed, then processing advances to step a S37 and then returns to step S32. If printing is not being performed, then a recovery operation is performed in a step S35. If the prescribed time has not been reached in step S32, then the normal processing of arithmetic operations, display, etc., is performed in a step S33. Furthermore, if the print selector switch is not in the on position in step S31, then processing proceeds to step S36, where arithmetic operations are only executed with the display and not the printer.

Figures 9A, 9B, 9C, 9D, 9E:
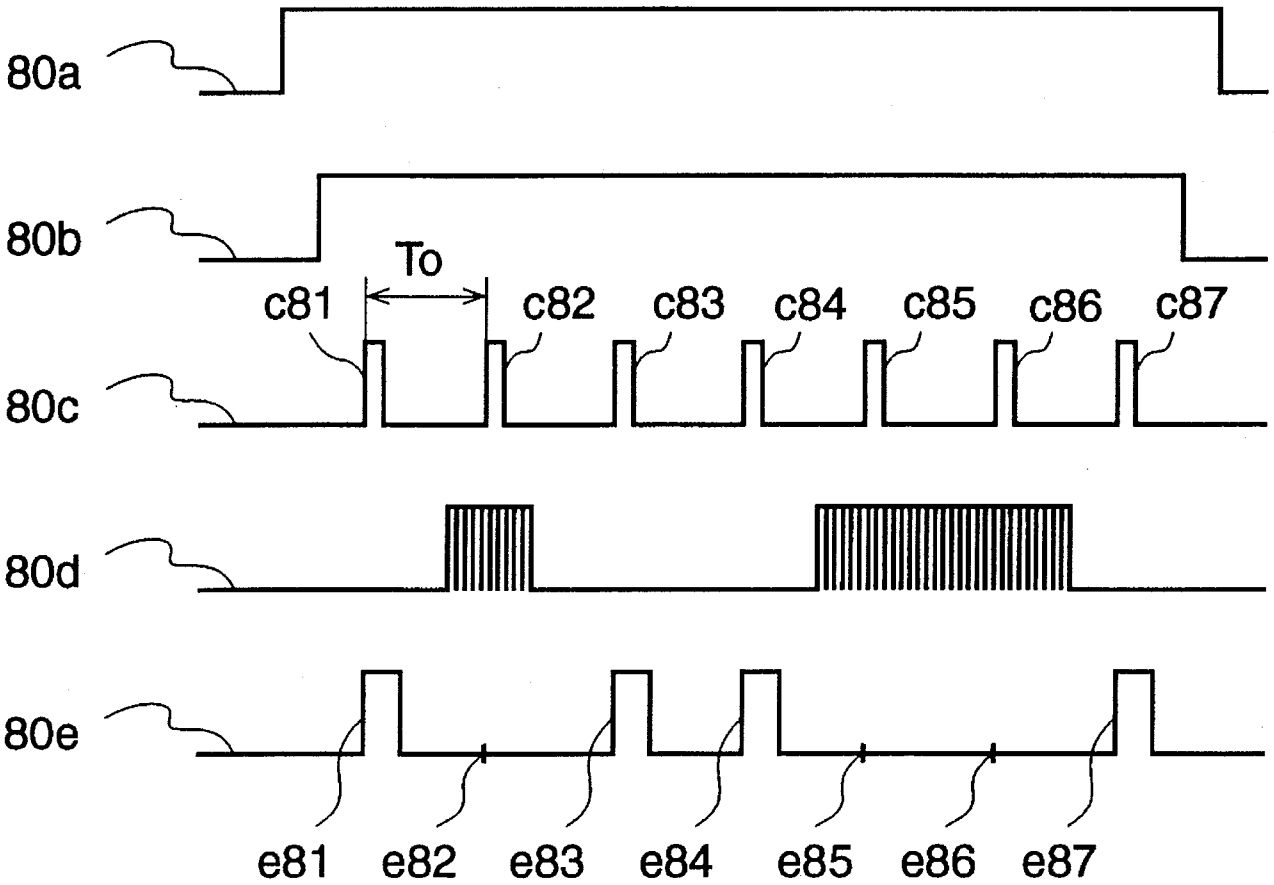
FIGS. 9A–9E illustrate timing charts for implementing the method of FIG. 8.

Timing charts are shown in FIGS. 9A–9F for use in explaining the operation of the control method of FIG. 8. In FIG. 9A, a waveform 80*a* indicates the status of the power source and 80*b* indicates the on/off status of the print selector switch. A signal 80*c* represents the output of the interval detector and the signal time interval $T_0$ indicates the length of each time period being detected which can be set as desired, but is placed at 15 minutes for this example. In FIGS. 9D and 9E, signals 80*d* and 80*e* are the print and recovery signals, respectively. From FIG. 9C, it is readily seen that as interval detection signal 80*c* provides output pulses c81, c82, etc., recovery operations are performed in response to recovery pulses e81, e83, e84, e87 which occur in response to pulses c81, c83, c84, c87, respectively, but no recovery operations are performed in response to pulses e82, e85, e86 which overlap printing operations.

Figure 10:
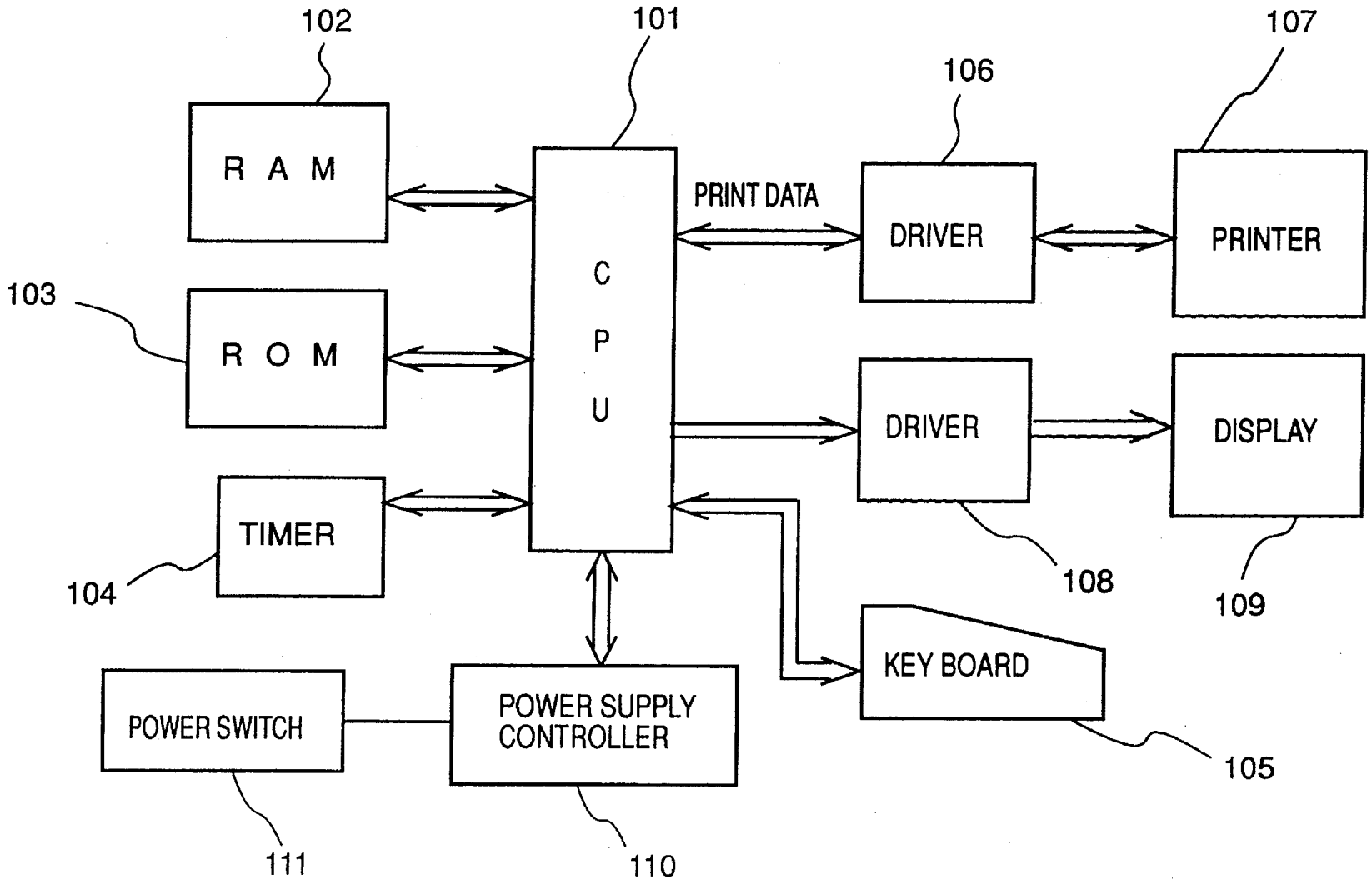
FIG. 10 illustrates a block diagram showing another embodiment of an electronic desk calculator for use in implementing the invention.

A block diagram of another embodiment of an electronic desk calculator employing the invention is shown in FIG. 10. Again, the same numbers as used in FIG. 2 indicate the same components and their explanation is omitted here. In FIG. 10, a power source controller 108 acts as a component for controlling the source of power, along with a power switch 109. Power source controller 108 is connected to CPU 101 and is configured such that it can switch the power source on and off for the entire electronic system in response to a command from the CPU according to the operating status of the calculator.

Figure 11:
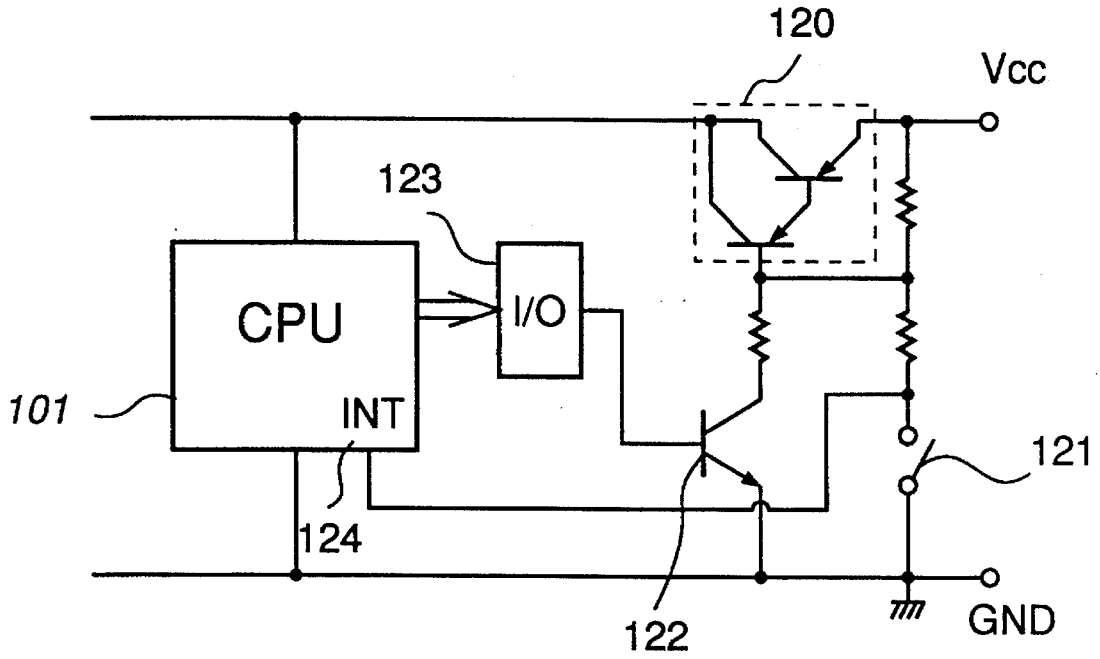
FIG. 11 illustrates an overview of one embodiment for a power source controller useful for implementing the invention.

A generalized diagram of one embodiment of a power source controller useful for implementing the invention is shown in FIG. 11, where a CPU 101 having an interrupt terminal 124 is connected to an I/O port 123 which is in turn connected to the input of a transistor 122 for amplifying signals provided by I/O port 123. A power transistor structure 120 selectively switches the supply of power from the $V_{cc}$ source on and off. A momentary contact type switch 121 having contacts that only close when depressed is also connected to selectively switch the power source on and off.

When switch 121 changes to an on state, power transistor 120 turns on and CPU 101 is reset. CPU 101 starts operating and switches transistor 122 on using signals through I/O port 123, and even if switch 121 is switched off, the supply of power from source Vcc continues. When CPU 101 executes or performs an auto-power off function, it turns off transistor 122 using I/O port 123, thereby turning off power transistor 120 and the supply of power is interrupted. Normally, when power is disconnected, the change in the state of momentary switch 121, as when the switch is turned on again, is detected using interrupt terminal 124 of CPU 101, and power transistor 120 is turned off using I/O port 123.

Figure 12:
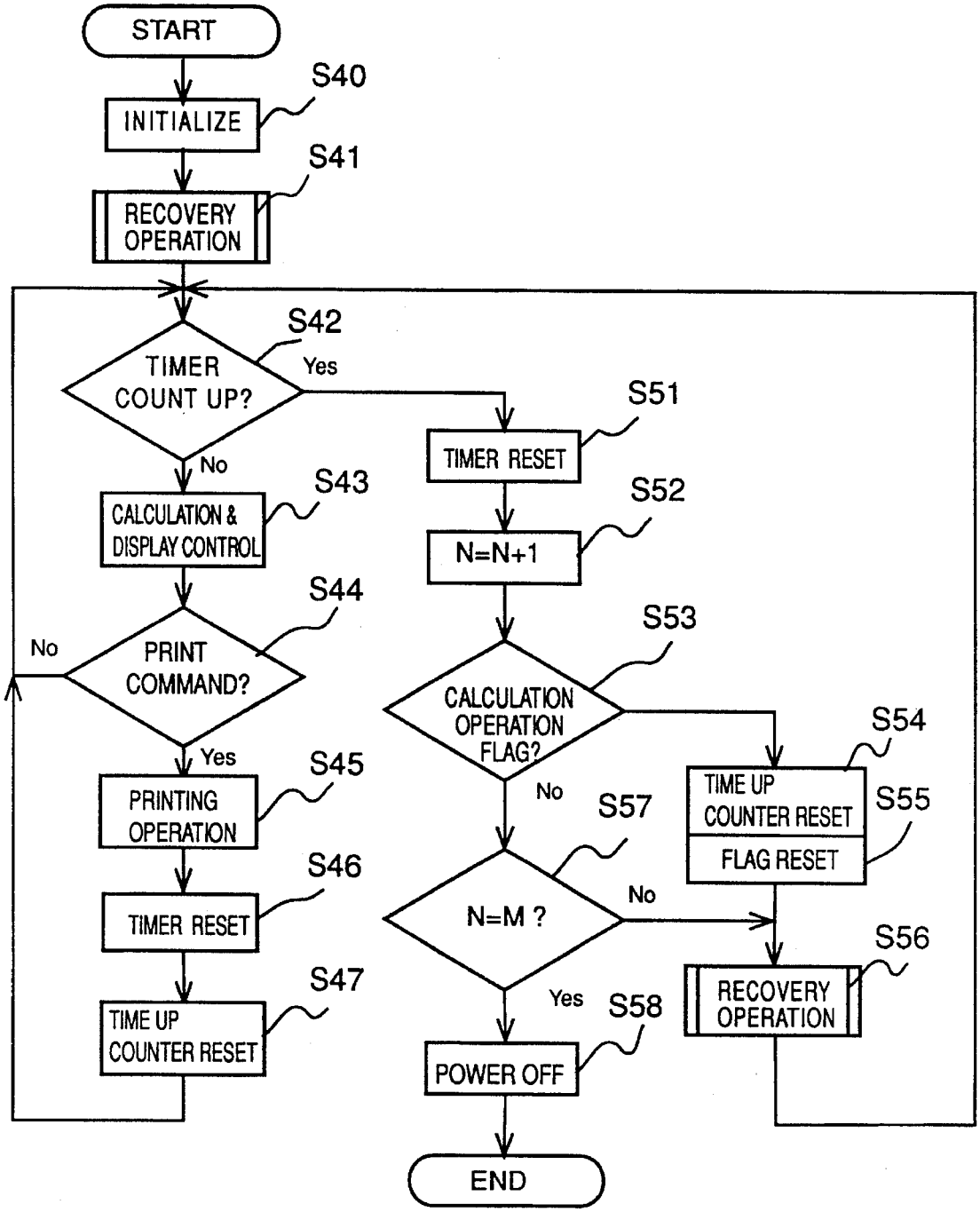
FIG. 12 illustrates a flowchart of a method of controlling the electronic desk calculator of FIG. 10.

A flowchart showing a control method for the electronic desk calculator shown in FIG. 10 is shown in FIG. 12.

In FIG. 12, the power transistor is switched on at the same time the calculator power switch is switched to the on position in a step S40, thereby supplying power to the entire electronic system. At this time, any circuits, the printer mechanism, etc., are all initialized and the timer is reset. Immediately following this, a recovery operation is performed on the ink-jet head in a step S41. In a step S42, a determination is made as to whether or not the timer has counted for a desired time period, and if not, then processing advances to step a S43 where arithmetic operations for processing data input from the keyboard, display, etc., are executed. Nothing is processed when merely waiting for key input during this time, and processing proceeds to the next step. Also, when processing is being executed, a flag indicating this fact is set and stored in a prescribed flag register.

Whether or not a print instruction has been generated is confirmed in a step S44, and if a print instruction has been generated, printing is executed in a step S45. If a print instruction has not been generated, then processing control returns to step S42 and the process steps are repeated. After printing is executed in step S45, the timer is reset in a step S46 and the register where the number of preselected time intervals is counted is reset in a step S47 and processing then returns to step S42.

If time has expired, however, processing advances to a step S51 in which the timer is reset, and then to a step S52 where the occurrence of this reset is added as a count to the number of time-ups and stored in the register. In a step S53, the flag register is checked to determine if any processing has been generated, and if the arithmetic operation and display processing flag has been set, processing proceeds to steps S54 and S55 where the flag and time-up counter are both reset, and then to a step S56 where one recovery operation is executed and then back to step S42.

If the flag register is empty, a determination is made in a step S57 as to whether or not the number of time-up events has reached the previously set limit, M, and if not then processing proceeds to a recovery operation in step S56. If the limit M has been reached, then no processing has been executed for a number of time-ups equal to the product of M and the individual time-up time, and in order to prevent wasteful ink consumption by the ink-jet head, processing proceeds to a step S58 where power controller 110 is activated to automatically disconnect or turn off the power. However, before disconnecting from the power source, processing may be performed to store data being processed in a non-volatile memory. Using this approach, the contents or substance of previous processing activities can be recovered the next time power is restored.

In this embodiment of the invention, recovery processing is performed by discharging ink at the prescribed time intervals during periods of non-use for the printer after power is switched on, and then, if printing is not performed continuously for a prescribed period of time, the power is turned off or disconnected.

In the above embodiment, 15 minutes is used as one example of the desired time interval, and if the setting M for counting the number of time-up intervals or occurrences is set at 4, then a recovery operation is executed if printing has not been performed for 15 minutes, and if key input or some other form of processing is not executed for a period of 60 minutes, based on 15 min, times 4 equals 60 min. After this recovery operation, power is automatically disconnected from the print head.

Using this technique, when the printer is left in an unused state for an extended period, due either to user inattention or simply because its use is not required, power and ink normally consumed by recovery processing are conserved. Also, when the electronic system is battery powered, battery life is lengthened by reducing the load otherwise placed on the battery by such processing. Furthermore, since the timer used in the recovery operation can easily be used to set a time delay for auto-power off, this simplifies the electronic system and can be applied to low-cost products such as desk calculators, without increasing their relative cost, thus making the invention extremely useful.

As before, to avoid unnecessary consumption of ink, the preselected time interval is set at 15 or 30 minutes. The prescribed expiration time may be set to 5, 10, or 60 minutes, and the recovery capacity of ink used in recovery processing may be specifically adjusted in this embodiment by varying the number of times discharge is repeated per nozzle. Generally the number of discharges is set to 5 every 15 minutes or 10 every 30 minutes per nozzle, in a given recovery operation. The number of ink discharges used when power is initially turned on or connected is set separately to 160 in this embodiment, as explained in reference to the ink characteristics. The reason why the maximum value (e.g., 160 discharges) for the minimum recoverable number of discharges is established separately for power initialization is, that while it is possible to measure remaining time using a timer when the power is on, it is generally difficult to do so when the power is off and still have a low-cost system.

Figure 13:
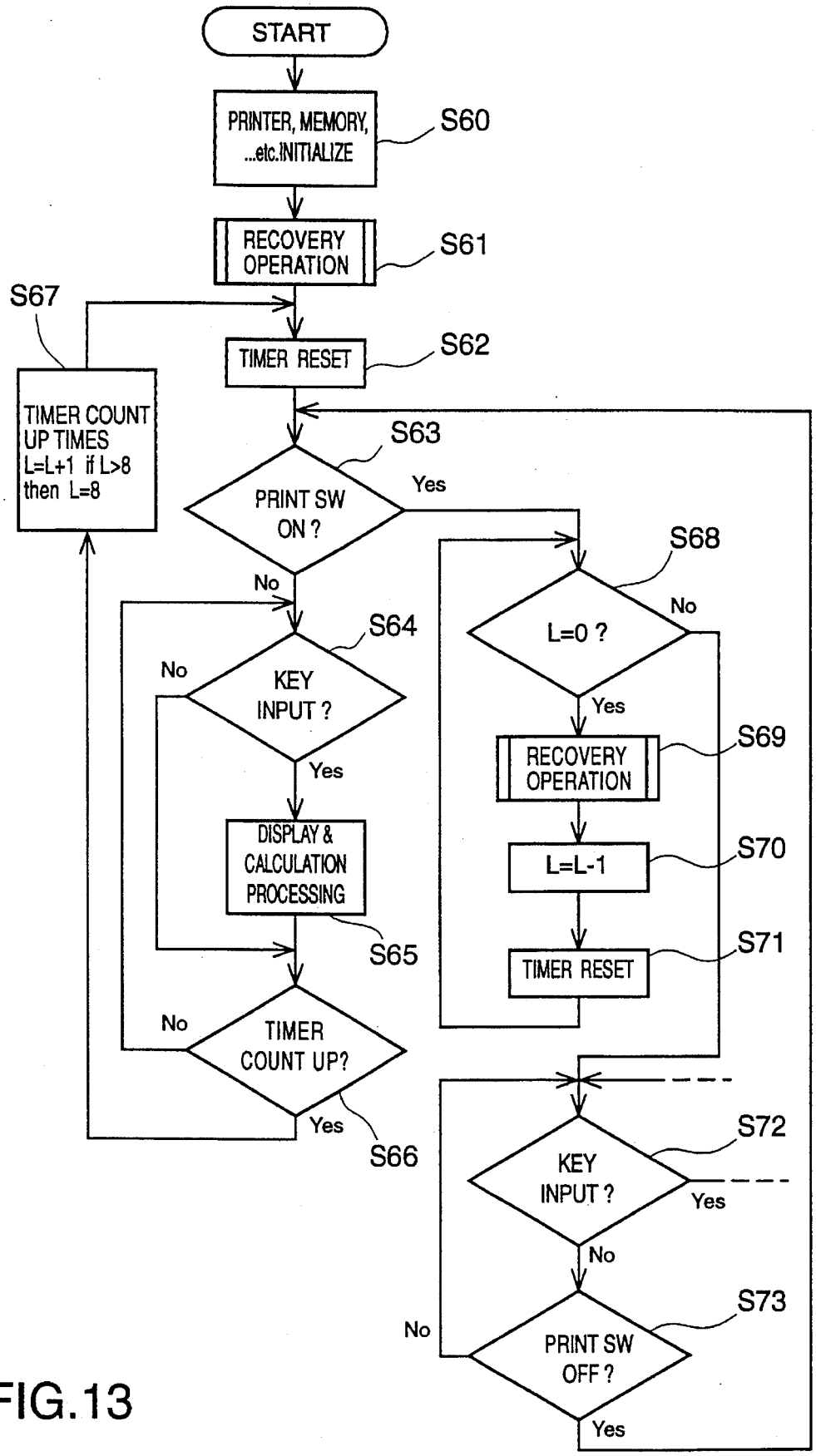
FIG. 13 illustrates a flowchart of yet another method of controlling an electronic system according to the invention.
Figures 14A, 14B, 14C, 14D, 14E, 14F:
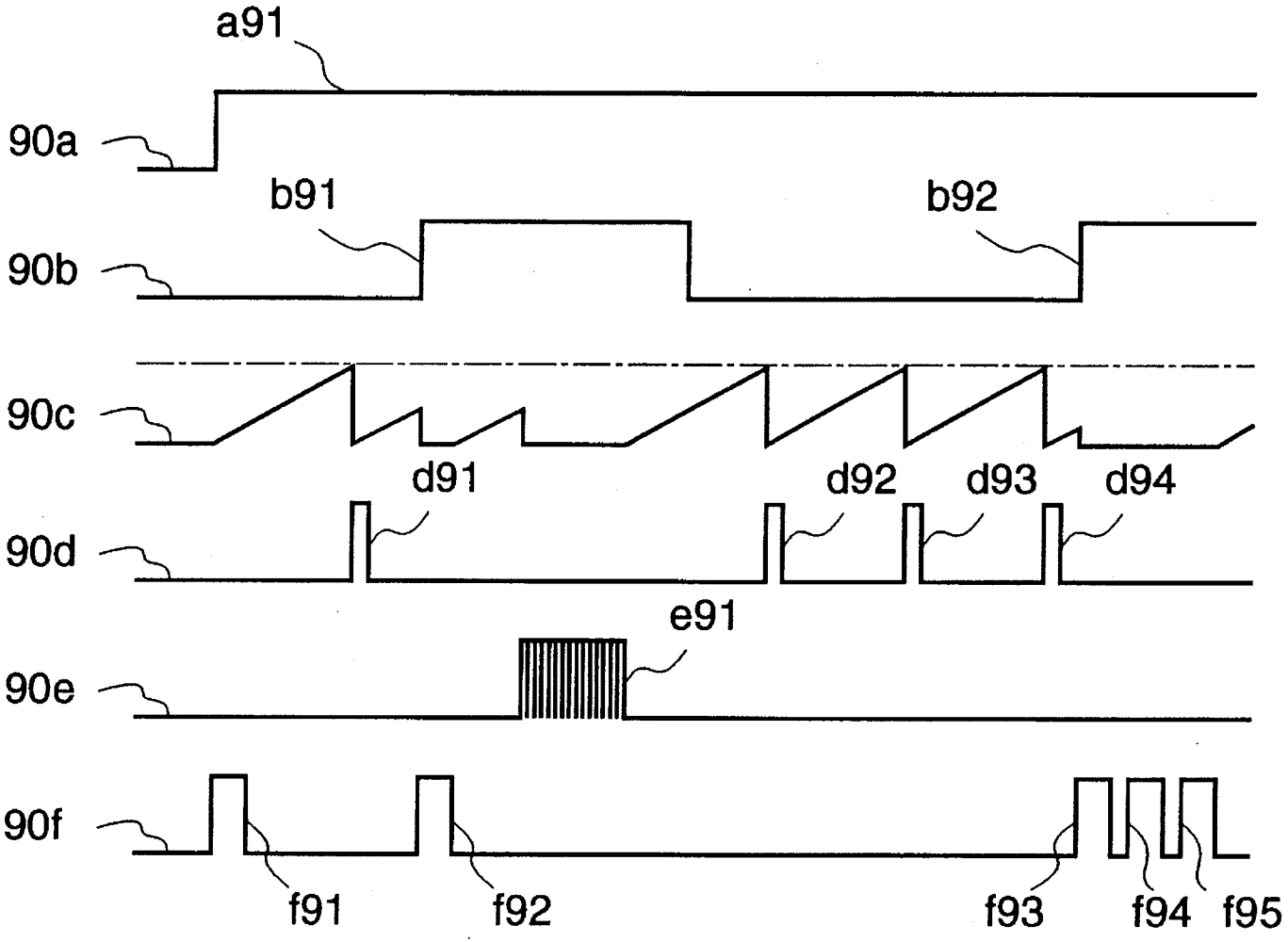
FIGS. 14A–14F illustrate timing charts for implementing the method of FIG. 13.

A flowchart of another embodiment for the electronic system and control method of the invention is shown in FIG. 13. In this embodiment, an electronic desk calculator is used as a type of electronic system, and it is represented by the same block diagram as used in FIG. 1.

In this embodiment, a controller is used that is capable of setting or selecting the recovery processing time based on the passage of time from when power is turned on until use of the printer portion of the electronic desk calculator begins. The controller can accurately measure time starting from when the power source is powered on, and suitably sets the amount of ink discharge performed during recovery operations. A timer 104 is used with a RAM 102 which acts as a means for counting the total number of time-up events or expired counting intervals "L" that occur after power is applied. The timing interval for each "time-up" event is nominally set at 30 minutes. Therefore, RAM 102 accrues a total count of how many times timer 104 reaches a 30 minute count, from this a total length of time during which the calculator is turned on but not using the printer can be accurately determined.

The printer, memory, etc., are first initialized in a step S60 immediately after power is switched on or applied to the calculator. The first recovery operation is then performed in a step S61. This recovery operation is indicated by steps SS1 through SS4 of the recovery operation sub-routine shown in FIG. 3. This recovery operation is executed when the power is switched on and upon completion, the timer is reset in a step S62.

Processing next proceeds from key input in a step S64 where a determination of the print selector switch position is made, to display and arithmetic operation processing in a step S65, and a check of the timer count in a step S66.

If it is determined that the preselected time interval has expired in step S66, the number L is incremented in step S67 so as to provide a total count of such occurrences. The number of occurrences for the "time-up" event are stored in a predetermined area or portion of RAM. Even if the measured value of L becomes larger than 16, the stored value is generally limited to 16, that is, a total time of 8 hours (as in, L×M=16×30 min.), although other values can be chosen as desired. This value is determined by the maximum time that the print head can remain unused and yet be adequately recovered using simple ink discharges. As discussed earlier, any length of time over about 6 hours is in fact a potential problem so that the value for L may be set lower, say to a value of 12 (so that L×M=12×30 min.).

While the print selector switch is in the off position, calculations, displaying results, etc., are each executed in response to key input according to the routine in steps S64 through S66. The provision of power to the printer mechanism is interrupted or disconnected during this time.

If the print selector switch is switched to the on position, then processing proceeds to a step S68, where whether or not L is equal to 0 is confirmed. If L is equal to 0, then processing advances to a step S72, and subsequently to the same processing steps shown in FIG. 5. If L is not equal to 0, then the recovery operation routine and timer reset are repeated L number of times, so that a head recovery process which is suitable to the amount of time the head is left unused, as shown in FIG. 17, is executed.

An advantage of employing the preselected time interval as a unit of time for measuring printer non-operation, and in storing the number of recovery operations M corresponding to this unit time in advance in a ROM, is that the proportional relationship shown in FIG. 17 can be easily used to set the number of recovery operations, based on the product of M and L. By using a single value for time-up events or interval timing to measure the period of time the printer remains unused during printer operations, the same timer can be used without requiring complicated control. There is also the advantage of being able to easily apply this method to hardware that uses the discharge of a capacitor as a timer.

Timing charts describing the operation of the embodiment shown in FIG. 13 are presented in FIGS. 14A–FIGS. 14F. 14A, a waveform 90*a* represents the timing for changing the power source between off and on states, while 90*b* represents the timing for changes in the state of the print selector switch between off and on positions. Signal waveform 90*c* indicates timer operation, where the single-dashed line again indicates the maximum count value for reaching the desired expiration or time-up time which corresponds to a prescribed value for the time or number of clock pulses measured by the timer. Signals 90*d*, 90*e*, and 90*f* represent the output of the timer, and printing and recovery control signals, respectively. The interval counted by the timer is the same as used in FIG. 6, i.e., 30 minutes, and the number of ink discharges performed during recovery is 10 per nozzle.

Immediately after power is applied as indicated by signal transition a91, recovery is performed in response to a signal transition or pulse f91, and a time-up signal pulse d91 is generated after the preselected time has elapsed. After the print selector switch is changed to the on position, as indicated by transition b91 in signal 90*b*, after performing calculations using the display device, a recovery signal pulse f92 is executed to commence recovery operations and printing is performed in response to a print signal pulse or series of pulses e91 within the prescribed time period. Following this, the print selector switch is switched to the off position and subsequently, after a delay, on again as indicated by transition b92. The period during which the printer switch is in the off position results in the generation of several, here three, time-up events as the preselected time interval expires several times, and three timer output pulses d92, d93, and d94. Therefore, three recovery signal pulses f93, f94, f95 are also executed in synchronization with the connection of power to the printer mechanism and L has a value of three (L=3).

In addition, when the time during which the ink-jet head remains unused, is relatively short, good quality printing can still be achieved without requiring recovery processing. When the preselected recoverable time is used to define the limits for what is a short time, printing can be performed without recovery processing if it is accomplished within the pre selected recoverable time. This is true because this time is equivalent to the time required for ink in the ink-jet print head nozzles to start changing viscosity or degrading, and is typically a time of between 15 and 30 minutes in this embodiment.

In the above embodiments of the invention, control of recovery processing is performed based on the output of a timer or timing device, but a device or elements for detecting temperature and humidity can also be used, and the output of the timer or the number of discharges can be adjusted accordingly. A variety of pressure generating elements can also be used in implementing the invention for discharging ink from the ink-jet nozzles such as piezoelectric elements, heating resistors, or many other elements.

The invention is applicable to a broad range of printers or electronic systems on which ink-jet printers are mounted. Furthermore, the printer section and data sources may be combined into a single unit or formed separately in such electronic systems.

The timer function in this embodiment may be accomplished by counting the clock pulses common to an entire system control section, or it may be configured by adding a divider circuit to provide a separate clock output. Recovery processing in this embodiment may be performed only on nozzles that print, or on a series or all of the nozzles, without deviating from the teachings of the invention.

As described above, using the ink-jet printer of the invention, ink in the nozzles whose viscosity has increased due to evaporation of the ink solvent within a prescribed period is ejected from the ink-jet head, whereby current ink viscosity or concentration is maintained constant within the nozzles. By maintaining a constant viscosity or concentration for discharging ink, ink is reliably and consistently discharged from the nozzles during printing. Since the quantity and speed of ink being discharged, and the reflectivity of the ink on the recording medium, remain substantially constant or consistent, printing quality is also consistent and printing can be performed with high reliability. Therefore, it is possible to offer a highly reliable printer with superior printing quality.

Since recovery processing is not performed immediately before a printing instruction or during printing operations, the time required for printing is also reduced, which effectively increases printing speed and makes it possible to offer a printer with superior performance. In electronic systems such as calculators having both a display device and printer which is used only as required, the number of recovery operations during actual printer use can be reduced, and waiting times before printing shortened. Furthermore, power and ink consumption during recovery processing are reduced when a printer or electronic system is not used for extended periods due to operator inattention or lack of any printing requirement.

As described above, the invention offers many advantages over the current art.

What is claimed is:

1. A control method for an electronic system having an ink-jet printer mechanism that discharges ink drops from nozzles of an ink-jet head, comprising the steps of:

(a) applying power from a main power source to the electronic system and detecting the application of power;

(b) performing recovery processing of the nozzles by discharging ink therefrom;

(c) enabling the ink-jet printer mechanism to print after step (a);

(d) measuring passage of time from when power is applied to the electronic system until the ink-jet printer mechanism is enabled to print; and (e) controlling the amount of ink discharged in a subsequent recovery processing to step (b), according to the length of time measured in step (d).

2. An electronic system having an ink-jet printer mechanism that discharges ink drops from nozzles of an ink-jet head, comprising:

(a) main power supply means for applying power to the electronic system and for detecting the application of power;

(b) printer selection means for selectively enabling the ink-jet printer mechanism to print after applying power to the electronic system;

(c) recovery means for performing a first recovery processing of the nozzles by discharging ink therefrom after power is applied to the electronic system and a second recovery processing of the nozzles by discharging ink therefrom after the ink-jet printer mechanism is enabled to print;

(d) timing means for measuring passage of time from when power is applied to the electronic system until the ink-jet printer mechanism is enabled to print; and (e) controller means for controlling the amount of ink discharged in the second recovery processing by said recovery processing means in accordance with the timing means.

3. A control method for an electronic system having an ink-jet printer mechanism that discharges ink drops from nozzles of an ink-jet head, comprising the steps of:

(a) applying power from a main power source to the electronic system and detecting the application of power;

(b) performing recovery processing of the nozzles by discharging ink therefrom;

(c) independently applying power from the main power source to the ink-jet printer mechanism after step (a);

(d) measuring passage of time from when power is applied to the electronic system until power is applied to the printer mechanism; and (e) controlling the amount of ink discharged in a subsequent recovery processing to step (b), according to the length of time measured in step (d).

4. An electronic system having an ink-jet printer mechanism that discharges ink drops from nozzles of an ink-jet head, comprising:

(a) main power supply means for applying power to the electronic system and for detecting the application of power and for independently applying power to the ink-jet printer mechanism after applying power to the electronic system;

(b) recovery means for performing a first recovery processing of the nozzles by discharging ink therefrom after power is applied to the electronic system and a second recovery processing of the nozzles by discharging ink therefrom;

(c) timing means for measuring passage of time from when power is applied to the electronic system until power is applied to the printer mechanism; and (d) controller means for controlling the amount of ink discharged in the second recovery processing by said recovery processing means in accordance with the timing means.

5. An electronic system having an inkjet printer mounted thereon having ink nozzles in an inkjet head, comprising:

detection means for detecting when power is applied to the system;

recovery means for performing recovery processing of the nozzles by discharging ink therefrom;

a print selector switch that selectively enables use of the inkjet printer;

timer means for measuring a preselected time period;

counter means for counting a number of times said timing means measures the preselected time period during a time when the power is applied to the system as detected by said detection means until said print selector switch enables the inkjet printer;

first memory means for storing the number of times counted by said counter means;

second memory means for storing a predetermined number of operations of said recovery means for recovering the nozzles corresponding to the preselected time; and control means for controlling said recovery means in synchronization with the printer enabled by said print selector switch so as to discharge the ink from the nozzles in accordance with the number of times stored in said first memory means and the predetermined number stored in said second memory means.

6. The system of claim 5 wherein said timer is configured as a programmable timer.

7. A method of controlling the recovery processing of nozzles in an inkjet printer having power applying means for applying power to the inkjet printer and print enabling means for enabling the inkjet printer to print, said method comprising the steps of:

discharging ink from the nozzles to perform recovery processing;

measuring a preselected time period;

counting a number of times the preselected time period is measured during a time when the power applying means applies power to the inkjet printer until a time when the enabling means enables the inkjet printer;

controlling said discharging step of the nozzles of the inkjet printer in accordance with (1) a predetermined number of discharge operations for recovering the nozzles in accordance with the preselected time, and (2) the number of times counted in said counting step.

8. An inkjet printer comprising:

applying means for applying power to the inkjet printer;

enabling means for enabling the inkjet printer after said applying means applies power to the inkjet printer;

a plurality of nozzles; and an ink recovery circuit for recovery processing of said nozzles by discharging ink therefrom, said ink recovery circuit comprising:

a detector, in communication with said applying means and said enabling means, for detecting a time when said applying means applies power to the inkjet printer until said enabling means enables the inkjet printer;

a timer for measuring a predetermined time;

a counter, in communication with said timer, for counting a number of times said timer measures the predetermined time during the time detected by said detector; and a controller, in communication with said nozzles and said counter, for controlling the discharging of said nozzles in accordance with (1) a predetermined number of operations for recovering the nozzles in accordance with the preselected time, and (2) the number of times counted by said counter.

* * * * *